US010517383B2

(12) United States Patent
Godin et al.

(10) Patent No.: US 10,517,383 B2
(45) Date of Patent: Dec. 31, 2019

(54) BRUSH HEAD WITH RECESSED BRISTLES, BRUSH, METHOD OF MAKING AND METHOD OF USING SAME

(71) Applicant: Shiseido Americas Corporation, New York, NY (US)

(72) Inventors: Sarina Godin, Seattle, WA (US); Jennifer Allen, Hillsborough, NJ (US); Julie Shown, San Francisco, CA (US)

(73) Assignee: Shiseido Americas Corporation, New York, NY (US)

( * ) Notice: Subject to any disclaimer, the term of this patent is extended or adjusted under 35 U.S.C. 154(b) by 214 days.

(21) Appl. No.: 15/584,899

(22) Filed: May 2, 2017

(65) Prior Publication Data

US 2017/0231378 A1 Aug. 17, 2017

Related U.S. Application Data

(63) Continuation-in-part of application No. 14/447,974, filed on Jul. 31, 2014, now Pat. No. 9,635,927, which (Continued)

(51) Int. Cl.

| | |
|---|---|
| ***A46B 9/02*** | (2006.01) |
| ***A46B 9/06*** | (2006.01) |
| ***A46B 9/08*** | (2006.01) |

(52) U.S. Cl.

CPC ..... *A46B 9/021* (2013.01); *A46B 9/028* (2013.01); *A46B 9/065* (2013.01); *A46B 9/08* (2013.01);

(Continued)

(58) Field of Classification Search

CPC ..... A46B 9/021; A46B 9/028; A46B 9/065; A46B 9/08; A46B 9/02; A46B 9/06

See application file for complete search history.

(56) References Cited

U.S. PATENT DOCUMENTS

| | | | |
|---|---|---|---|
| 299,144 | A | 5/1884 | Huntbatch |
| 421,812 | A | 2/1890 | Bonner |

(Continued)

FOREIGN PATENT DOCUMENTS

| | | |
|---|---|---|
| DE | 202014003461 | 5/2014 |
| FR | 663618 | 8/1929 |

(Continued)

OTHER PUBLICATIONS

BareSkin® Foundation, Pure Brightening Serum Foundation, materials from www.bareescentuals.com (obtained Jul. 16, 2014, per document itself).

(Continued)

*Primary Examiner* — Shay Karls

(74) *Attorney, Agent, or Firm* — Calderone Bullock LLC

(57) ABSTRACT

The present invention recognizes that there exists a long felt need for brush heads and brushes having material application and buffing properties. A first aspect of the present invention is a brush head. A second aspect of the present invention is a brush including a brush head of the present invention. A third aspect of the present invention is a method of making a brush head of the present invention. A fourth aspect of the present invention is a method of making a brush of the present invention. A fifth aspect of the present invention is a method of using a brush head of the present invention. A sixth aspect of the present invention is a method of using a brush of the present invention. An additional aspect is a brush head having an outer zone of bristles and a convex inner zone of bristles.

29 Claims, 14 Drawing Sheets

Related U.S. Application Data is a continuation-in-part of application No. 29/485,705, filed on Mar. 21, 2014, now Pat. No. Des. 793,090, application No. 15/584,899, which is a continuation-in-part of application No. 29/568,752, filed on Jun. 21, 2016, now Pat. No. Des. 824,678, which is a continuation of application No. 29/517,382, filed on Feb. 12, 2015, now Pat. No. Des. 770,185, which is a continuation-in-part of application No. 14/447,974, filed on Jul. 31, 2014, now Pat. No. 9,635,927, which is a continuation-in-part of application No. 29/485,705, filed on Mar. 21, 2014, now Pat. No. Des. 793,090.

(52) U.S. Cl.
CPC . *A46B 9/02* (2013.01); *A46B 9/06* (2013.01); *A46B 2200/1046* (2013.01)

(56) References Cited

U.S. PATENT DOCUMENTS 681,148 A 8/1901 Stow
790,622 A 5/1905 Erskine
862,038 A 7/1907 Wayman
876,371 A 1/1908 Matchette et al.
925,178 A 6/1909 Hardman
955,061 A 4/1910 Erskine
1,092,710 A 4/1914 Hartmann
1,106,378 A 8/1914 Hardman
1,120,476 A 12/1914 Hansen
1,153,118 A 9/1915 Kimes
1,197,210 A 9/1916 Jordan
1,247,484 A 11/1917 Albrecht, Jr.
1,358,597 A 11/1920 Tobias
1,359,733 A 11/1920 Palmer
1,392,369 A 10/1921 Stoewsand
1,396,474 A 11/1921 Tibbetts
1,412,958 A 4/1922 Pearlmutter
1,419,887 A 6/1922 Myers
1,493,775 A 5/1924 Fetters
1,563,031 A 11/1925 Jones
1,597,998 A 8/1926 Nielsen
1,617,569 A 2/1927 Boyle
D73,782 S 11/1927 Fuld
1,694,364 A 12/1928 Albright
1,716,211 A 6/1929 Cuevas
1,749,052 A 3/1930 Watt
1,763,905 A 6/1930 Rusell
1,783,754 A 12/1930 Stepelton
1,810,544 A 6/1931 Trupiano
1,813,615 A 7/1931 Frazier
1,815,119 A 7/1931 Skvorecz
1,852,839 A 4/1932 Engberg et al.
1,858,452 A 5/1932 Lancellotti
1,904,612 A 4/1933 Bramson
1,920,398 A 8/1933 Jones
1,923,884 A 8/1933 Pushee
1,956,477 A 4/1934 Segal
1,981,851 A 11/1934 Aten
2,025,734 A 12/1935 Ell
2,033,615 A 3/1936 Ell
2,065,592 A 12/1936 Lofgren
2,067,756 A 1/1937 Espinosa
2,108,742 A 2/1938 Bickel
2,145,570 A 1/1939 Miettunen
2,214,989 A 9/1940 Brand
2,240,547 A 5/1941 Buddish
2,305,282 A 12/1942 Taylor et al.
2,320,545 A 6/1943 Ross
2,358,252 A 9/1944 Rowan
2,425,474 A 8/1947 Hussey
D149,060 S 3/1948 Harvuot
2,529,036 A 11/1950 Loewinsohn
2,535,716 A 12/1950 Bella
2,548,429 A 4/1951 Fitzgerald
2,618,008 A 11/1952 Hageal et al.
2,730,753 A 1/1956 Gerber
2,756,908 A 7/1956 Miller
2,778,048 A 1/1957 Nielsen
2,984,852 A 5/1961 George
3,205,523 A 9/1965 Seaver
3,309,727 A 3/1967 Snodderly
3,309,728 A 3/1967 Seaver
3,312,993 A 4/1967 Nelson
3,343,201 A 9/1967 Cox
3,346,267 A 10/1967 Farley
3,351,418 A 11/1967 Karnuth
3,376,095 A 4/1968 Modola
3,450,412 A 6/1969 Collett
3,470,890 A 10/1969 Nakata
3,577,835 A 5/1971 Horton et al.
3,653,090 A 4/1972 Weaver
3,724,337 A 4/1973 Richardson
3,839,763 A 10/1974 Gould
3,978,852 A 9/1976 Annoni
4,106,182 A 8/1978 Blackwell
D251,159 S 2/1979 Tolliver
4,252,455 A 2/1981 de la Pena
4,254,962 A 3/1981 Blackwell
4,317,407 A 3/1982 Blackwell
4,454,622 A 6/1984 Poppendieck
4,485,514 A 12/1984 Droeser
D278,951 S 5/1985 Kalinsky
D278,952 S 5/1985 Kalinsky
4,603,992 A 8/1986 Kavoussi
4,605,022 A 8/1986 Gueret
4,626,119 A 12/1986 Ladd, Jr.
D304,392 S 11/1989 Reich
4,944,625 A 7/1990 Futter
D310,918 S 10/1990 Futter
D311,279 S 10/1990 Lin
4,972,541 A 11/1990 Smith, Jr.
4,998,316 A 3/1991 Maltarp
D320,698 S 10/1991 Reich
5,123,142 A 6/1992 Miller
5,195,546 A 3/1993 Cansler
D350,853 S 9/1994 Basque
5,373,599 A 12/1994 Lemon
D361,434 S 8/1995 Summers
5,474,664 A 12/1995 Thompson
5,497,607 A 3/1996 Branson
D400,325 S 10/1998 Broecking
D401,254 S 11/1998 Sajakorpi et al.
D405,572 S 2/1999 Bouchez
D406,389 S 3/1999 Henry
5,976,692 A 11/1999 Brezler, III
6,081,958 A 7/2000 Van Staagen
D430,731 S 9/2000 Chen
6,142,695 A 11/2000 Byun
6,205,609 B1 3/2001 Sajakorpi et al.
6,217,124 B1 4/2001 Jespersen
6,224,287 B1 5/2001 Gieux
6,260,927 B1 7/2001 Sajakorpi et al.
D448,119 S 9/2001 Neues
D450,930 S 11/2001 Mink
6,347,425 B1 2/2002 Fattori
D456,942 S 5/2002 Au
6,398,027 B1 6/2002 Ryu
6,490,747 B1 12/2002 Metwally
D480,217 S 10/2003 Mink
D493,287 S 7/2004 Hay
6,795,997 B1 9/2004 Lin
6,802,104 B1 10/2004 Redd
D519,696 S 4/2006 Adams
D528,736 S 9/2006 Koenig
7,107,645 B2 9/2006 Bressler
D536,177 S 2/2007 Arnaud
D538,473 S 3/2007 Rhoades
D562,005 S 2/2008 King
D571,105 S 6/2008 Godin
7,571,514 B2 8/2009 Shih
D601,804 S 10/2009 Hwang

(56) References Cited

U.S. PATENT DOCUMENTS

| | | | | |
|---|---|---|---|---|
| D603,570 | S | 11/2009 | Svantesson et al. | |
| D613,070 | S | 4/2010 | Huang | |
| 7,735,552 | B2 | 6/2010 | Xu | |
| 7,775,737 | B2 | 8/2010 | Deans et al. | |
| 7,784,137 | B2 | 8/2010 | Knopow | |
| 7,802,339 | B2 | 9/2010 | Kuivikko et al. | |
| D640,471 | S | 6/2011 | Lin | |
| D644,030 | S | 8/2011 | Gates | |
| 8,060,971 | B1 | 11/2011 | Castelluccio | |
| 8,104,132 | B2 | 1/2012 | Mink | |
| D659,923 | S | 5/2012 | Dyson | |
| D663,957 | S | 7/2012 | Garcia | |
| 8,356,377 | B2 | 1/2013 | Harper | |
| D676,666 | S | 2/2013 | Nelson | |
| D692,672 | S | 11/2013 | Chan et al. | |
| D697,314 | S | 1/2014 | Tronconi | |
| 8,678,693 | B2 | 3/2014 | Sturgis | |
| D706,542 | S | 6/2014 | Lavigne | |
| 8,777,507 | B1 | 7/2014 | Carey | |
| D715,558 | S | 10/2014 | Brewer | |
| D727,033 | S | 4/2015 | Shafer | |
| D728,943 | S | 5/2015 | Carpentier | |
| 9,204,704 | B1 | 12/2015 | Wolfe | |
| D753,399 | S | 4/2016 | Owen | |
| D755,525 | S | 5/2016 | Ward | |
| D755,526 | S | 5/2016 | Ward | |
| D757,442 | S | 5/2016 | Waitesmith | |
| D760,455 | S | 6/2016 | Shinozaki | |
| D766,586 | S | 9/2016 | Hwang | |
| D770,185 | S | 11/2016 | Shown et al. | |
| D777,448 | S | 1/2017 | Saputo et al. | |
| D787,190 | S | 5/2017 | Machiorlette et al. | |
| D787,193 | S | 5/2017 | Hwang | |
| 9,635,927 | B2 | 5/2017 | Godin et al. | |
| D789,094 | S | 6/2017 | Flavard | |
| D793,090 | S | 8/2017 | Allen et al. | |
| 9,763,511 | B2 | 9/2017 | Nakamura et al. | |
| D809,230 | S | 1/2018 | Bowen | |
| 2001/0052160 | A1 | 12/2001 | Dorf | |
| 2002/0181998 | A1 | 12/2002 | Petit | |
| 2004/0089318 | A1 | 5/2004 | Tahara | |
| 2004/0107521 | A1 | 6/2004 | Chan | |
| 2004/0134002 | A1 | 7/2004 | Zimmer | |
| 2004/0154125 | A1 | 8/2004 | Houvener | |
| 2004/0205916 | A1 | 10/2004 | Byun | |
| 2005/0044660 | A1 | 3/2005 | Kim | |
| 2005/0045200 | A1* | 3/2005 | Zeunik | A45D 27/04 132/290 |
| 2005/0138746 | A1 | 6/2005 | Young-Chul | |
| 2005/0188999 | A1 | 9/2005 | Byun | |
| 2005/0257337 | A1 | 11/2005 | Clegg | |
| 2006/0090277 | A1 | 5/2006 | Petit | |
| 2007/0098485 | A1 | 5/2007 | Byun | |
| 2007/0177930 | A1 | 8/2007 | Byun | |
| 2007/0209675 | A1 | 9/2007 | Byun | |
| 2008/0063672 | A1 | 3/2008 | Mandelli | |
| 2009/0089949 | A1 | 4/2009 | Mink | |
| 2009/0180825 | A1 | 7/2009 | Chang | |
| 2010/0003066 | A1 | 1/2010 | Thorpe | |
| 2010/0021229 | A1 | 1/2010 | Byun | |
| 2010/0077559 | A1 | 4/2010 | Mink | |
| 2010/0095973 | A1 | 4/2010 | Shrier | |
| 2010/0101035 | A1 | 4/2010 | Nakamura | |
| 2011/0174680 | A1 | 7/2011 | Arvin | |
| 2012/0260931 | A1 | 10/2012 | Martin | |
| 2012/0272982 | A1 | 11/2012 | Telwar | |
| 2013/0014338 | A1 | 1/2013 | Park | |
| 2013/0111688 | A1 | 5/2013 | Lim | |
| 2013/0199558 | A1 | 8/2013 | Feller | |
| 2013/0263886 | A1 | 10/2013 | Brescia | |
| 2013/0312784 | A1 | 11/2013 | Greiner | |
| 2014/0317864 | A1 | 10/2014 | Walther | |
| 2014/0325775 | A1 | 11/2014 | Nakamura | |
| 2014/0325779 | A1 | 11/2014 | Dansby | |
| 2014/0331428 | A1 | 11/2014 | Nakamura | |
| 2014/0331429 | A1 | 11/2014 | Lim | |
| 2015/0121638 | A1 | 5/2015 | Lim | |
| 2015/0143652 | A1 | 5/2015 | Walker | |
| 2015/0265039 | A1 | 9/2015 | Godin | |
| 2015/0296965 | A1 | 10/2015 | Peskin | |
| 2015/0296968 | A1 | 10/2015 | Hwang | |
| 2016/0324306 | A1 | 11/2016 | Martin et al. | |

FOREIGN PATENT DOCUMENTS

| | | | | |
|---|---|---|---|---|
| JP | 1521255 | | 4/2015 | |
| WO | WO-2015025873 | A1 * | 2/2015 | A46B 9/021 |

OTHER PUBLICATIONS

Perfecting Face Brush, materials from www.bareescentuals.com (obtained Jul. 16, 2014, per document itself).

Materials from Bare Escentuals Beauty, Inc. at email@bareescentuals.com (obtained Jul. 10, 2014).

Sephora Collection: Flatter Yourself Contour Brush Set, posted at Sephora.com, earliest date reviewed Jan. 23, 2014, [online], acquired on Aug. 31, 2016. Available from the internet using Web Archive: <URL: http://www.sephora.com/flatter-yourself-contouring-brush-set-P384889?skuld=1564566&icid2=products%20grid:p384889#pdp-reviews>.

MakeupByJoyce—Brush Reviews Sigma F80, posted at makeupbyjoyce.com, earliest available date Mar. 23, 2013, [online], acquired on Sep. 29, 2016. Available from the Internet using Web Archive: <URL: http://web.archive.org/web/*/http://makeupbyjoyce.com>.

Cafe Makeup—Brushes and Tools, Sep. 2011 [online], Shiseido Foundation Brush, pp. 10-11, [retrieved on Jan. 8, 2015]; Retrieved from the Internet using Web Archive:<http://web.archive.org/web/*/http://ww/cafemakeup.com>.

Materials from Bare Escentuals Beauty, Inc. at email@bareescentuals.com (obtained Feb. 19, 2014, per document itself).

Materials from Loew Cornell at www.lowe-cornell.com (obtained Mar. 12, 2014, per document itself).

Wettability, non-wettability and contact angle hysteresis, materials from http://web.mit.edu (obtained Jul. 17, 2014, per document itself).

Wetting, materials from http://en.wikipedia.org (obtained Jul. 17, 2014, per document itself).

Contact angle, materials from http://en.wikipedia.org (obtained Jul. 17, 2014, per document itself).

Standard Practices for Surface Wettability of Coatings, Substrates and Pigments for Advancing Contact Angle Measurements, materials from www.astm.org (obtained Jul. 17, 2014, per document itself).

First Chinese Office Action dated May 31, 2018 in counterpart Chinese Application No. 2014104295685 (11 pages) (Chinese only).

U.S. Appl. No. 29/560,648, Godin et al.

U.S. Appl. No. 29/568,749, Godin et al.

U.S. Appl. No. 29/568,752, Shown et al.

* cited by examiner

BRUSH HEAD WITH RECESSED BRISTLES, BRUSH, METHOD OF MAKING AND METHOD OF USING SAME

CROSS-REFERENCE TO RELATED APPLICATIONS

The present application is a Continuation-in-Part application of U.S. patent application Ser. No. 14/447,974, filed on Jul. 31, 2014 entitled "Brush Head with Recessed Bristles, Brush, Method of Making and Method of Using Same," which is a Continuation-in-Part of U.S. Design Pat. Application Ser. No. 29/485,705, filed Mar. 21, 2014; and the present application is also a Continuation-in-Part of U.S. Design Pat. Application Ser. No. 29/568,752, filed Jun. 21, 2016, entitled "Brush Head Skirt" which is a continuation of U.S. Design Pat. Application Ser. No. 29/517,382, filed Feb. 12, 2015, entitled "Brush Head With Recessed Convex Bristles," which is a Continuation-in-Part of U.S. patent application Ser. No. 14/447,974, filed on Jul. 31, 2014 entitled "Brush Head with Recessed Bristles, Brush, Method of Making and Method of Using Same," which is a Continuation-in-Part of U.S. Design Pat. Application Ser. No. 29/485,705, filed Mar. 21, 2014, entitled "Brush Head with Recessed Bristles," the disclosures of each of which are incorporated by reference herein in their entirety.

BACKGROUND OF THE INVENTION

Technical Field

The present invention generally relates to the fields of brush heads, brushes, and methods of making and using the same.

A wide variety of brush heads and brushes are used for a variety of purposes, inclusive of cleaning and application of materials to surfaces for industry, hobby, artistic and cosmetic purposes, to name a few. Although the number and type of brushes are varied, none have the attributes of the brush heads and brushes of the present invention, being a brush head and brush with a section of recessed bristles. None are known to have the physical and material application characteristics of the present invention.

For example, U.S. Pat. No. D663,957 S, issued Jul. 24, 2012 to Garcia, refers to a brush with an apparent gap in the central portion of the brush, wherein the brush is evidently used for hobby and fine art purposes. The central gap is apparently too small to accept a material, and if it were able to accept a material, the intent of the brush is apparently to smear or streak a material when applied to a surface for an artistic effect when in use for painting surfaces for a craft project or fine art projects, such as, for example, cups, plates, figurines, and paintings on canvas.

A common problem with traditional brushes is the uneven application of makeup or other substance which may result in smears, streaks or an unnatural or undesirable look or appearance, particularly, but not limited, to the instance of the application of cosmetics. The present invention, however, is directed more towards preventing or reducing the appearance of such smears or streaks, but that need not be the case.

Further, another problem with traditional brushes is the difficulty in retaining and applying solid materials, such as powdered cosmetics, among others. U.S. Pat. No. 1,120,476, issued to Hansen, discloses a shaving brush with an outer and inner group of bristles, providing a spreading member and a powder retaining member. Hansen provides that the outer extremities of the inner bristles are disposed in the same general plan and parallel to the spreading extremities of the outer bristles.

Other brushes provide only a single tuft or zone of bristles, such as U.S. Patent Application Publication No. 2009/0089949 of Mink et al., which provides a shaving brush having synthetic bristles that are arranged in a tuft, having the appearance, texture and feel of badger fur and having antimicrobial properties. Further, U.S. Pat. No. 5,195,546 issued to Cansler discloses a cosmetic brush for applying powder made from synthetic bristles with a gentle random and irregular wavy configuration along the lengths of the bristles.

Traditional brushes may not readily pick-up and hold a solid or powdered material, such as a powdered cosmetic. As a result, the solid material may fall from the brush head during transfer of the solid material to a surface, creating a mess and inhibiting application of the solid material to the surface. Additionally, traditional brushes, including cosmetic brushes, may not be well adapted for applying a solid material, such as a powdered cosmetic, to a large surface area, such as a person's neck or shoulders. As a result, it may be time consuming to fully apply the solid material to the desired surface and the user may be required to repeatedly collect solid cosmetic on the brush and then apply the cosmetic to the surface in order to fully cover the surface.

BRIEF SUMMARY OF THE INVENTION

The present invention recognizes that there exists a long felt need for brush heads and brushes having material application and buffing properties.

A first aspect of the present invention is a brush head.

A second aspect of the present invention is a brush including a brush head of the present invention.

A third aspect of the present invention is a method of making a brush head of the present invention.

A fourth aspect of the present invention is a method of making a brush of the present invention.

A fifth aspect of the present invention is a method of using a brush head of the present invention.

A sixth aspect of the present invention is a method of using a brush of the present invention.

A further aspect of the present invention is a brush head for applying a solid material, comprising an outer zone of bristles and an inner zone of bristles, defining a reservoir, wherein the inner zone of bristles has a convex configuration in a longitudinal cross section and is configured to retain a solid material, such as a powdered cosmetic for application to a surface. The convex inner zone of bristles is preferably rounded in a longitudinal cross section, and the inner zone of bristles may have a dome shape.

The present invention further relates to a brush head having an inner zone with a convex configuration wherein the outer and/or inner zones of bristles are outwardly tapered in a longitudinal cross sectional view. Further, the outer zone of bristles may include a flat surface defined by the tips of the bristles in a longitudinal cross sectional view.

The present invention further relates to a brush head having an inner zone with a convex configuration wherein the outer and/or inner zones of bristles are generally circular when viewed in a top elevational plan view.

The present invention relates to a brush head having a convex inner zone of bristles, wherein the inner zone of bristles comprises a greater pack density than that of the outer zone.

The present invention further relates to a brush head having a convex inner zone of recessed bristles, wherein the brush head is preferably used to apply a solid cosmetic, such as a powdered cosmetic, wherein solid cosmetics may be considered to include medicaments, cosmeceuticals, or similar topically applied materials.

The present invention further relates to a system for applying a solid material to a surface using a brush head, wherein the brush head comprises an outer zone of bristles and an inner zone of recessed bristles, defining a reservoir, wherein the inner zone of bristles comprises a convex configuration in a longitudinal cross sectional view. The inner zone of bristles may be rounded in a longitudinal cross sectional view, and may have a dome shape. The system for applying a solid material may further comprise a handle attached to the brush head and/or a ferrule, ring or crimping region for holding the bristles.

The present invention further relates to a method of using a brush for applying a cosmetic comprising: providing a brush head having an outer zone of bristles and an inner zone of recessed bristles, defining a reservoir, wherein the inner zone of recessed bristles comprises a convex configuration in a longitudinal cross sectional view; applying the cosmetic to the brush head such that the brush head retains the cosmetic; and transferring the cosmetic to a surface. The cosmetic may be held on top of the bristles or between the bristles of the brush head. The method may include pressing the brush head into a cosmetic to be transferred to a surface, and/or applying a circular or swirling motion to the cosmetic to enable the brush to pick-up and retain the cosmetic.

The present invention further provides a method for making a brush and/or brush head comprising: providing bristles, arranging the bristles into an inner zone and an outer zone, forming the bristles into a brush head of the present invention. The method may further include attaching the brush head to a handle and/or securing the bristles with a crimping region, ring or ferrule.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

Figure 1:
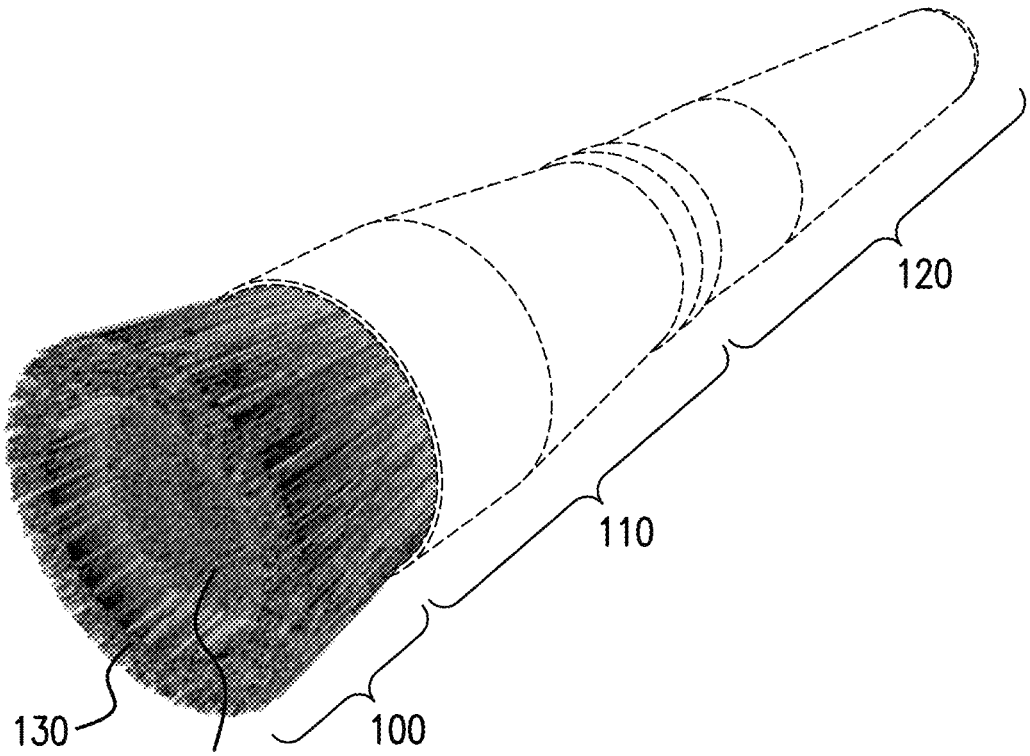
FIG. 1 generally depicts a front and right perspective view of one aspect of a brush head of the present invention with recessed bristles that can form a reservoir for material to be applied to a surface, such as but not limited to a liquid cosmetic material applied to a human subject's face, showing the environment inclusive of a ferrule and a handle. The brush as a whole can include a brush head (100), a ferrule (110) and a handle (120). The brush head can include an outer zone of bristles (130) and an inner zone of recessed bristles (140).
Figure 2:
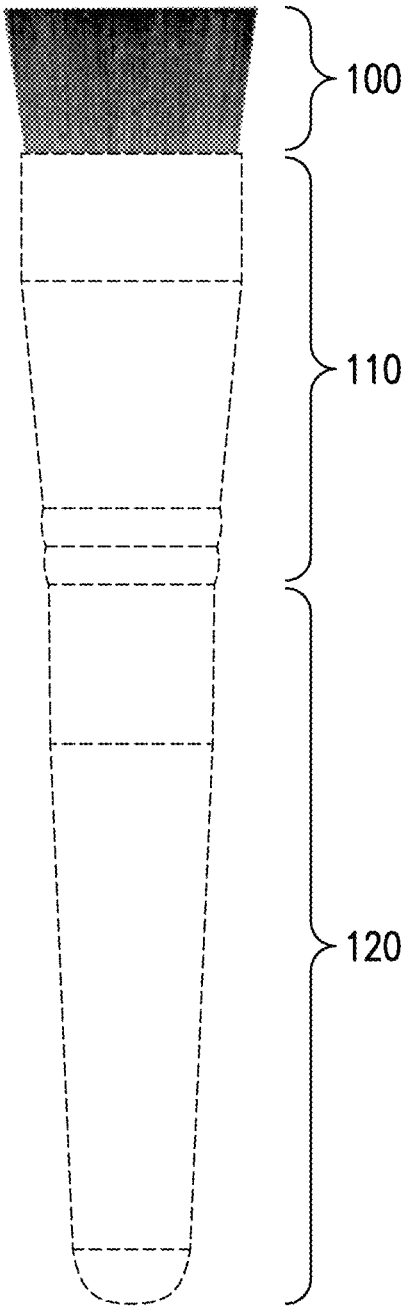
FIG. 2 generally depicts a right side view of one aspect of a brush head of the present invention with recessed bristles that can form a reservoir for material to be applied to a surface, such as but not limited to a liquid cosmetic material applied to a human subject's face, the left side, front side, and back side being mirror images thereof. The element numbers as are provided in FIG. 1.
Figure 3:
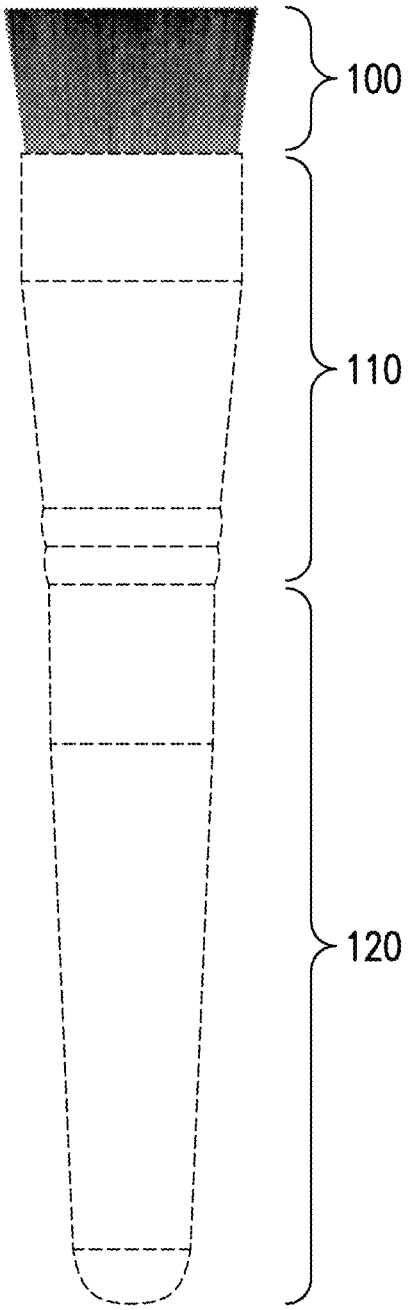
FIG. 3 generally depicts a left side, front side, and back side view of one aspect of a brush head of the present invention with recessed bristles that can form a reservoir for material to be applied to a surface, such as but not limited to a liquid cosmetic material applied to a human subject's face, as per FIG. 2. The element numbers as are provided in FIG. 1.
Figure 4:
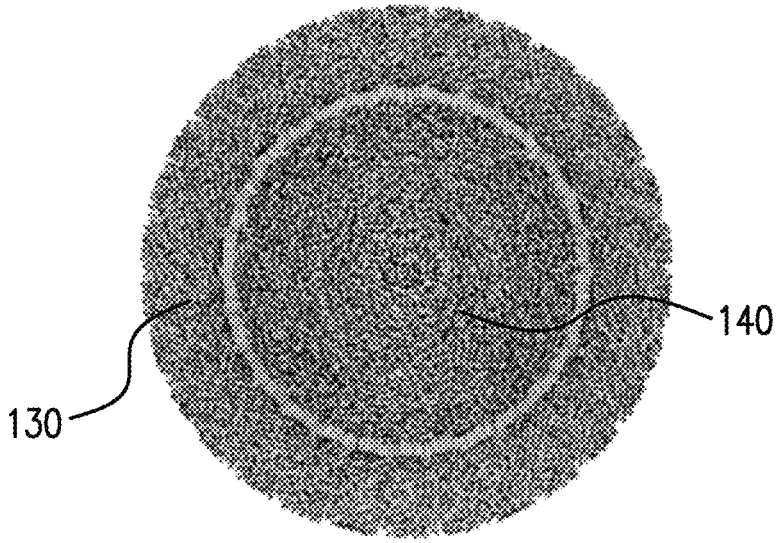
FIG. 4 generally depicts a top view of one aspect of a brush head of the present invention with recessed bristles that can form a reservoir for material to be applied to a surface, such as but not limited to a liquid cosmetic material applied to a human subject's face. The element numbers as are provided in FIG. 1.
Figure 5:
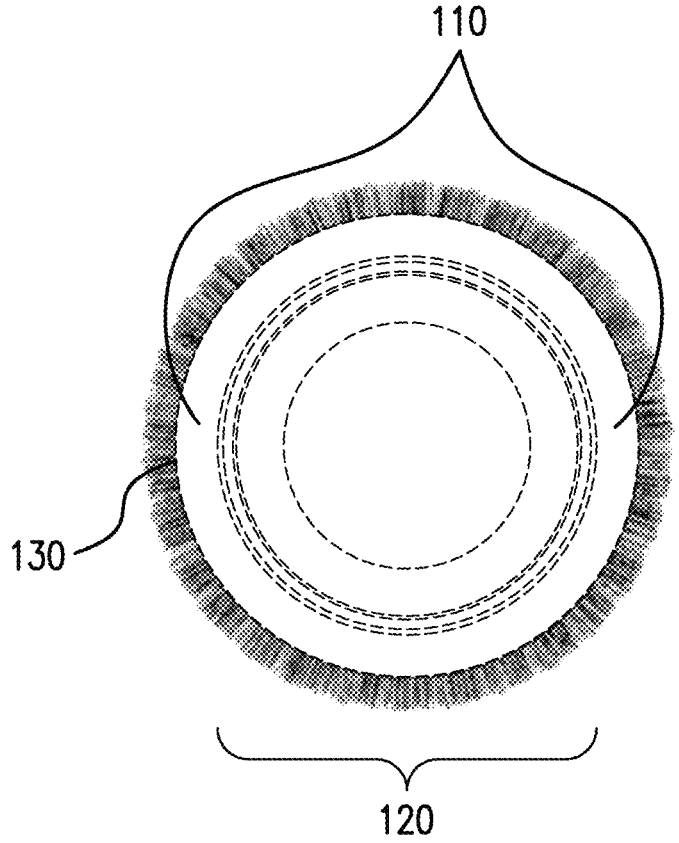
FIG. 5 generally depicts a bottom view of one aspect of a brush head of the present invention with recessed bristles that can form a reservoir for material to be applied to a surface, such as but not limited to a liquid cosmetic material applied to a human subject's face. The element numbers as are provided in FIG. 1.

The broken lines shown in the drawings, when present, are for illustrative purposes only and depict but one environment that the present invention can be provided, but that need not be the case.

DETAILED DESCRIPTION OF THE INVENTION

Unless defined otherwise, all technical and scientific terms used herein have the same meaning as commonly understood by one of ordinary skill in the art to which this invention belongs. Generally, the nomenclature used herein and the laboratory procedures in brush heads and brushes in general, for cosmetics, surface chemistry and modification, and other applicable technologies described below are well known and commonly employed in the art. Where a term is provided in the singular, the inventors also contemplate the plural of that term, and when a term is provided in the plural, the inventors also contemplate the singular of that term. The nomenclature used herein and the laboratory procedures described below are those well-known and commonly employed in the art unless set forth otherwise. As employed throughout the disclosure, the following terms, unless otherwise indicated, shall be understood to have the following meanings:

Wettability and wetting refer to the ability of a liquid to absorb into a surface. For example, a drop of water on a household sponge would tend to wet the sponge, whereas a drop of water on common glass would not tend to wet the glass. Wettability or wetting can be a term of degree and not necessarily one of an absolute positive or negative result. This term and concept is well known in the art. (See, generally, for example: Wetting, at http://en.wikipedia.org/wiki/wetting, Contact Angle, at http://en.wikipedia.org/wiki/contact angle, Standard Practice for Surface Wettability of Coating, Substrates and Pigments by Advancing Contact Angle Measurement, at http://www.astm.org/standards/d7334.htm. and 6) Wettability, non-wettability and contact angle hysteresis, at http://web.mit.edu.nnf/educationlwettability/wetting.html.).

Contact angle determinations also refer to the ability of a surface to absorb a substance. A hydrophilic liquid being applied to a hydrophobic surface would tend to bead up on the surface and thus have a relatively high contact angle, as an example. A low or minimal contact angle would occur as the liquid is absorbed into or spread out upon a surface, such as a drop of water being applied to cellulose filter paper or household tissue paper or paper towels, or a drop of water on glass. Alternatively, a drop of water on the waxy coat of a leaf, or on the surface of a newly waxed automobile, would have a relatively high contact angle. This term and concept is well known in the art. (See, generally, for example: Wetting, at http://en.wikipedia.org/wiki/wetting, Contact Angle, at http://en.wikipedia.org/wiki/contact angle, Standard Practice for Surface Wettability of Coating, Substrates and Pigments by Advancing Contact Angle Measurement, at http://www.astm.org/standards/d7334.htm. and 6) Wettability, non-wettability and contact angle hysteresis, at http://web.mit.edu.nnf/educationlwettability/wetting.html.).

Reference in this specification to "one embodiment" or "an embodiment" means that a particular feature, structure, or characteristic described in connection with the embodiment is included in at least one embodiment of the disclosure. The use of the phrase "in one embodiment" or "in another embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described, which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for anyone or more of the terms discussed herein. Nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," and "below" used herein are merely for ease of description and refer to the orientation of the components as shown in the figures. It should be understood that any orientation of the components described herein is within the scope of the present invention.

Other technical terms used herein have their ordinary meaning in the art that they are used, as exemplified by a variety of technical dictionaries.

The present invention recognizes that there exists a long felt need for brush heads and brushes having material application and buffing properties.

As a non-limiting introduction to the breadth of the present invention, the present invention includes several general and useful aspects, including:

1) Brush heads.

2) Brushes including a brush head of the present invention.

3) A method of making brush heads of the present invention.

4) A method of making brushes of the present invention.

5) A method of using brush heads of the present invention.

6) A method of using brushes of the present invention.

These aspects of the invention, as well as others described herein, can be achieved by using the methods, articles of manufacture and compositions of matter described herein. To gain a full appreciation of the scope of the present invention, it will be further recognized that various aspects of the present invention can be combined to make desirable embodiments of the invention.

I. Brush Heads

A first aspect of the present invention is a brush head that includes: a) an outer zone of bristles, and b) an inner zone of recessed bristles.

As depicted in FIGS. 1-11, showing a non-limiting preferred aspect of the present invention, an outer zone of bristles is present, which provides for an inner zone of recessed bristles. The brush head of this embodiment of the present invention need not have this particular configuration.

As an example, the outer zone need not be continuous and can have gaps and the like, nor need be uniform in thickness or height overall or relative to the inner zone. The surface of the outer zone as defined by the tips of the bristles and/or may be of different lengths of bristles and can form different types of patterns, such as a wavy pattern, or can have random or seemingly random lengths of bristles to provide for a "feathered" appearance, by varying the length of the bristles in a specific pattern or in a random fashion. The bristles may be substantially linear in configuration along the length thereof, or may be wavy along the length thereof.

As a further example, the inner zone also need not be continuous and can have gaps and the like, nor need be uniform in thickness or height overall or relative to the outer zone. The surface of the inner zone may be of different lengths of bristles and can form different types of patterns, such as wavy, or have random or seemingly random lengths of bristles to provide for a "feathered" appearance.

Further, the outer zone and the inner zone can be contiguous and not as distinct such as is shown in the figures. For example, the inner zone can be a concave configuration formed, for example, from a flat top brush where, for example, a hot wire is used to form a contiguous concave inner zone while forming an outer zone, wherein the outer zone can be substantial or minimal.

The embodiment of FIGS. 12-21 also depicts a non-limiting embodiment of the present invention, having an outer zone of bristles and a convex inner zone of recessed bristles, defining a reservoir. As an example, the inner and outer zones need not be continuous and can have gaps and the like, nor need be uniform in thickness or height overall.

The surface of the outer zone as defined by the tips of the bristles and/or may be of different lengths of bristles and can form different types of patterns, such as a flat or wavy pattern, or can have random or seemingly random lengths of bristles to provide for a "feathered" appearance, by varying the length of the bristles in a specific pattern or in a random fashion. Preferably, the bristles in the inner and outer zones are composed of the same type of material, such as but not limited to polybutylene terephthalate (PBT).

In another aspect of the present invention, the brush head is a cosmetic brush head or a non-cosmetic brush head.

A preferred aspect of the present invention is a cosmetic applicator brush head, where a cosmetic is provided in a preferred embodiment to the inner zone for application to a surface of a subject, and outer zone preferably disperses the cosmetic on the surface of the subject to allow for reduced streaking and otherwise provide for generally more uniform and pleasing application of the cosmetic to a surface of a subject.

In addition to a cosmetic brush head, the brush heads of the present invention can be used for the application of other materials to other surfaces and for other purposes. As an example, the brush heads can be used for application of paints and other pigment containing materials such as ink to a surface. Industrial applications as well as artistic applications are a part of the present invention, In addition, the brush heads of the present invention are applicable for cleaning and the like.

In that instance, a cleaning material such as a cleaning solution, can optionally be applied to a brush head of the present invention and used for cleaning purposes such as dusting, surface cleansing of other surfaces, floors as an example. The instance where no material is applied to the brush head is also part of the present invention.

Furthermore, the brush heads of the present invention are applicable for medical applications in applying a medicament, medicine, or a drug to a subject. In this instance, the material to apply has medicinal purposes and can include a medicament, medicine, or drug. For example, the material may be used to treat acne, dermatitis, infection, immunological conditions such as poison ivy or psoriasis, or other disorders such as but not limited to dermatological disorders. Application of drugs, medicament or medicine to the skin has certain benefits as to targeting the treatment to a desired locus, and also as an efficient route of administration for more systemic administration, particularly if the skin is or is made permeable to the medicament, medicine, or drug. The correlation of the formulation of the material to be applied and the locus of application and the disease, disorder, or condition to be treated are choices of the practitioner. The matching of medicament, drug, or medicine to a disease, disorder, or condition, and the particular formulations are generally known in the art and are choices of the practitioners in the field.

In a further aspect of the present invention, the brush heads of the present invention are cosmetic brush heads.

A preferred aspect of the present invention is a cosmetic applicator brush head, where a cosmetic is provided in a preferred embodiment to the inner zone for application to a surface of a subject, and outer zone preferably disperses the cosmetic on the surface of the subject to allow for reduced streaking and otherwise provide for generally more uniform and pleasing application of the cosmetic to a surface of a subject.

The cosmetic can be of any type, such as but not limited to liquid, solid, powdered, aqueous, non-aqueous, emulsions, polar, non-polar, others as known in the art, or a combination thereof.

In an additional aspect of the present invention, the shape of the outer zone and the inner zone are the same or different.

As shown in the figures, a preferred aspect of the present invention is circular or substantially circular, as to the inner zone and outer zone, but that need not be the case. For example, the outer zone may be circular, and the inner zone may be circular or a polygon such as an octagon.

In another aspect of the present invention, the shape of the outer zone, the inner zone, or a combination thereof is generally geometrical, generally non-geometrical, or a combination thereof.

Different geometric or non-geometric configurations in combination are part of the present invention. As an example, the outer zone may be circular or kidney shaped, whereas the inner zone may be hexagonal or amoeboid shaped, indicating the same or different shapes being used and that geometric and non-geometric shapes are also part of the present invention.

In a further aspect of the present invention, the shape of the inner zone, the inner zone, or a combination thereof is generally circular.

As to shape, the overall shape of the brush head when viewed in longitudinal cross sectional view, the surface defined by the tips of the bristles in the outer zone can be flat as shown in the figures. The inner and outer zones can separately or individually be the same shape or different shapes, such as angled, beveled, random, convex, concave, geometric, non-geometric or a combination thereof, depending upon the embodiment and the desired end application for the brush head.

Figure 12:
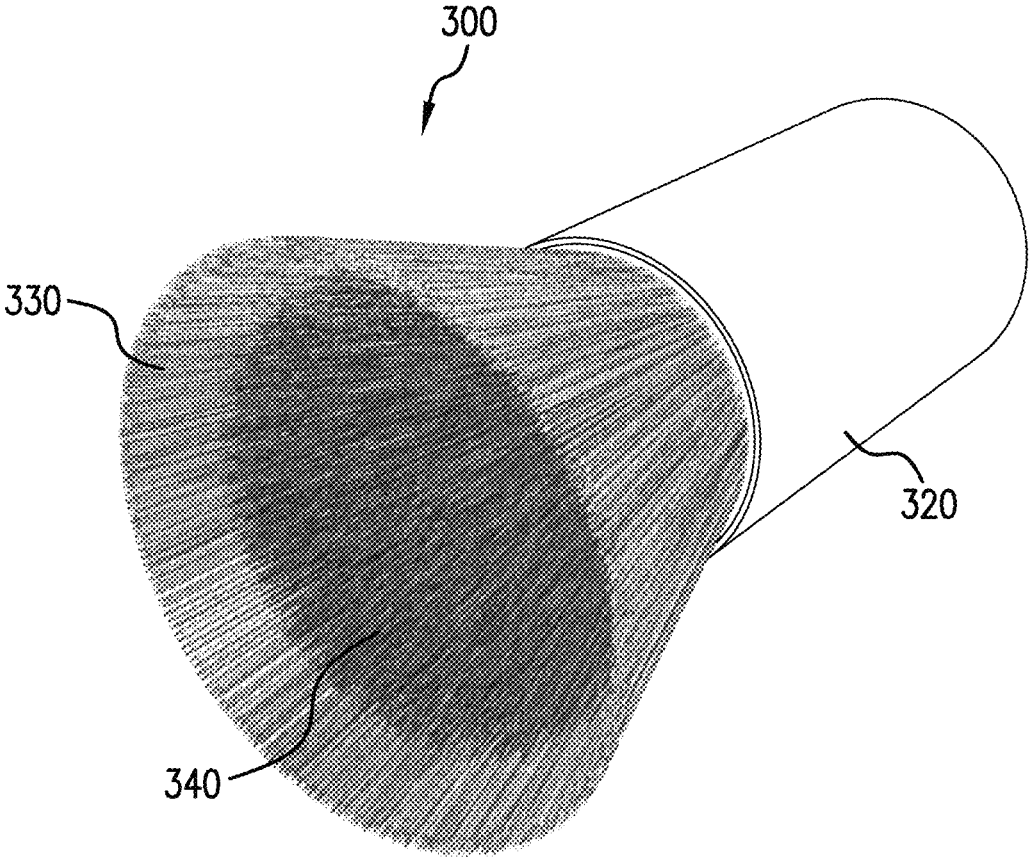
FIG. 12 generally depicts a front perspective view of an embodiment of a brush head with a convex inner zone of bristles for application of a solid material to a surface, such as but not limited to application of a powder cosmetic to a human's face. The brush head (300) generally includes an outer zone of bristles (330) and an inner zone of recessed bristles (340) having a convex curvature in longitudinal cross sectional view. When configured as a brush, the brush includes a handle (320).
Figure 13:
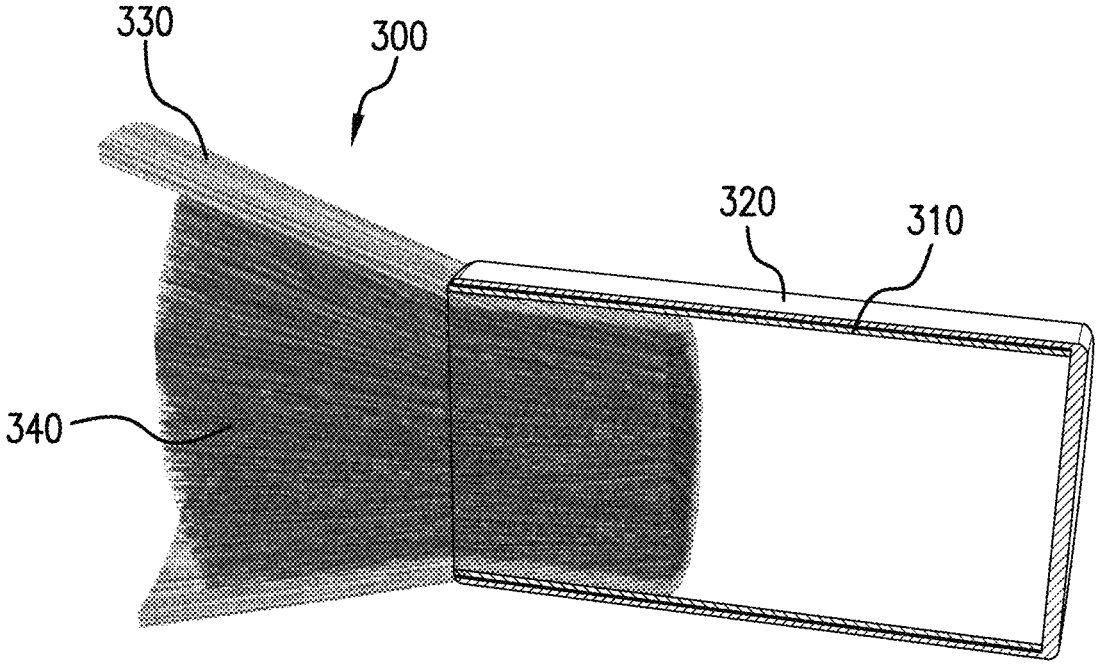
FIG. 13 generally depicts a perspective cross-sectional view of an embodiment of a brush head with a convex inner zone of bristles for application of a solid material to a surface, such as but not limited to application of a powder cosmetic to a human's face. The element numbers are provided as per FIG. 12.
Figure 14:
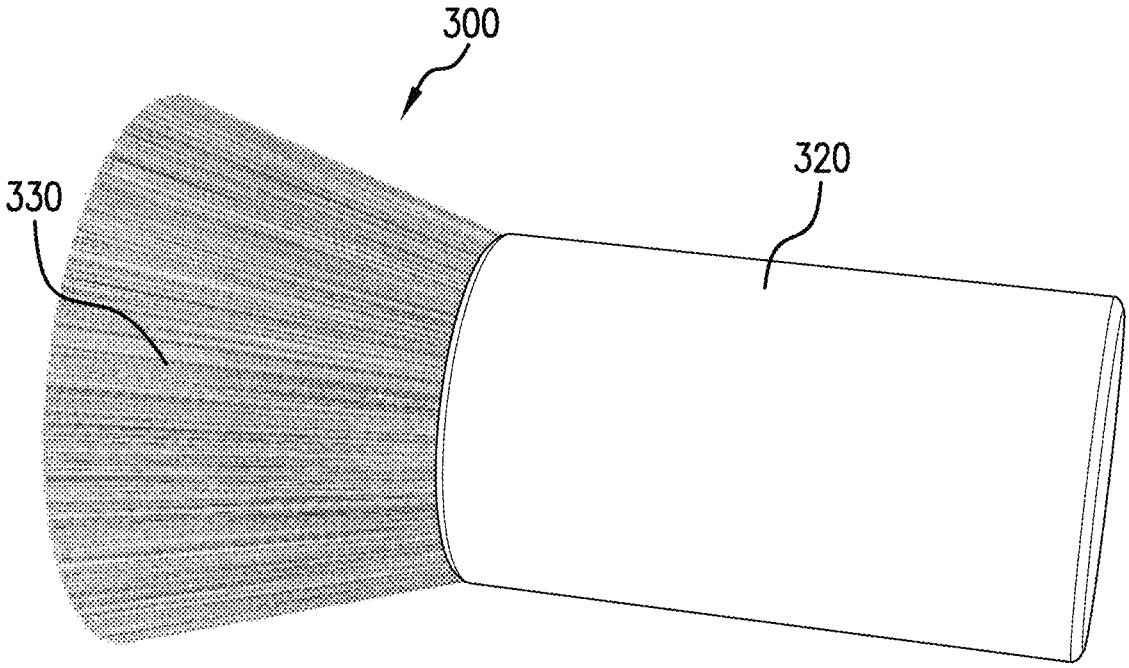
FIG. 14 generally depicts a side perspective view of an embodiment of a brush head with a convex inner zone of bristles for application of a solid material to a surface, such as but not limited to application of a powder cosmetic to a human's face. The element numbers are provided as per FIG. 12.
Figure 15:
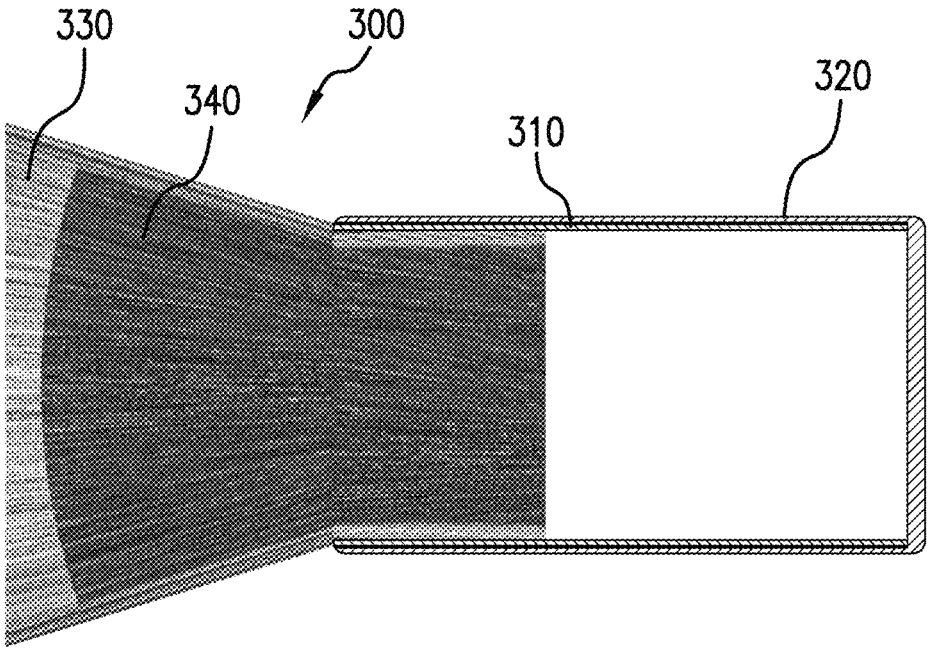
FIG. 15 generally depicts a longitudinal cross-sectional view of an embodiment of a brush head with an inner zone of bristles have a convex configuration for application of a solid material to a surface, such as but not limited to application of a powder cosmetic to a human's face. The element numbers are provided as per FIG. 12.
Figure 16:
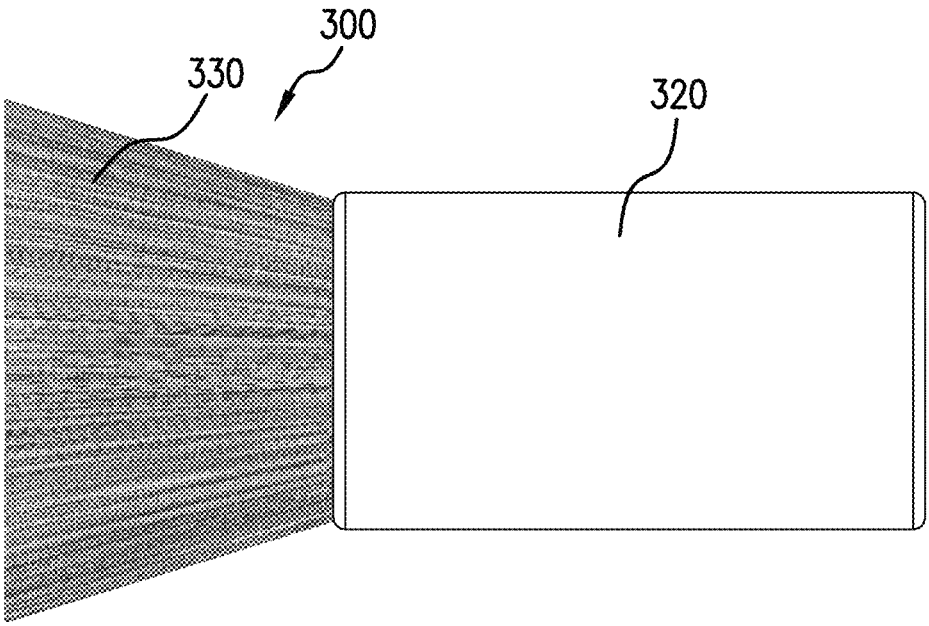
FIG. 16 generally depicts a longitudinal side elevational view of an embodiment of a brush head with an inner zone of bristles have a convex configuration for application of a solid material to a surface, such as but not limited to application of a powder cosmetic to a human's face. The element numbers are provided as per FIG. 12.

In the embodiment of FIGS. 12-21, the inner zone of bristles has a convex configuration in a longitudinal cross sectional view, as best shown in FIGS. 13 and 15. This brush head having a convex configuration of the inner zone is particularly suited for use in applying solid materials, such as powdered cosmetics, such as loose powder, compressed powder, blush, and other similar cosmetics, in addition to other personal care materials, such as powders, topical medicaments, or cosmeceuticals, among others. In this embodiment, the bristles in the center of the inner zone have the greatest height or extend outward from the brush head to the greatest extent, whereas the height of the bristles in the inner zone of bristles or the extent to which the bristles extend outward from the bottom of the brush head gradually decreases as the distance from the center of the inner zone increases so as to provide the inner zone with a convex configuration, having a rounded or dome-shape. Further, the peak or highest point of the convex inner zone of bristles is preferably at or below the height of the outer zone of bristles. In embodiments wherein the inner zone of bristles is below the height of the outer zone of bristles, the peak or highest point of the inner zone is preferably between about 1 mm and 6 mm below the tips of the bristles in the outer zone. However, in alternate embodiments, the peak of the inner zone may rise to the same height as the outer zone or to a height slightly greater than that of the outer zone, such as 1 to about 12 mm about the height of the outer zone, provided that the brush head still achieves the desired properties described herein.

In the embodiment of the brush shown in FIG. 12, the inner zone may have a pack density that is less than, the same as, or greater than that of the outer zone of bristles. Preferably, the inner zone has a greater pack density than the outer zone of bristles, which improves the ability of the inner zone to retain a powdered cosmetic. Thus, the inner zone bristles are more tightly packed and are less flexible than the outer zone of bristles, allowing the outer zone of bristles to be better suited for smoothing and buffing due to their flexibility. In one embodiment, the weight of the inner zone of bristles is 19.3 grams, while the weight of the outer zone of bristles is 5.7 grams. In such embodiments wherein the inner and outer zone of bristles are composed of the same material, the inner zone of bristles occupy a greater portion of the brush head than the outer zone of bristles, and further the inner zone of bristles is relatively dense in comparison to the outer zone of bristles. In one embodiment, the inner zone of bristles has approximately 60,795 bristles and the outer zone of bristles has 17,955 bristles.

Further, the outer zone of bristles has an outwardly tapered configuration when viewed in the longitudinal cross section, as shown in FIGS. 15-16 and FIGS. 19-21, and may also have a flat configuration defined by the tips of the bristles in the outer zone. However, in alternate embodiments, the tips of the bristles of the outer zone are wavy or feathered and have random or seemingly random lengths of bristles. The convex inner zone of bristles preferably also has an outwardly tapered configuration in longitudinal cross section, as shown in FIGS. 13 and 15. The outward taper provides a wide brush head that can cover a greater area of a surface to allow for rapid application of a solid material, such as a bronzer or highlighter, to a large area, such as a human's neck, collarbones, and/or shoulders.

When viewed in longitudinal cross section, the brush head can have other configurations, such as the outwardly tapered configuration in the figures, not tapered, inwardly tapered, or other configurations as well, depending upon the embodiment.

Figure 17:
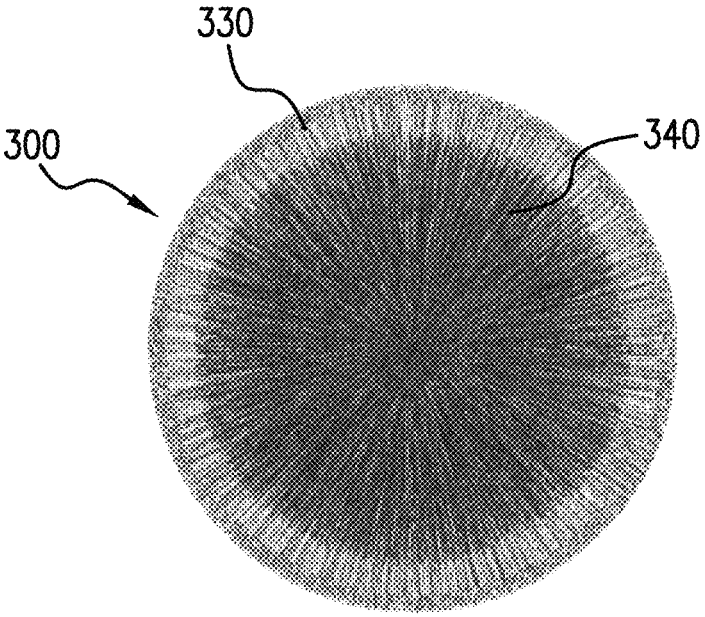
FIG. 17 generally depicts a top elevational plan view of an embodiment of a brush head with an inner zone of bristles have a convex configuration for application of a solid material to a surface, such as but not limited to application of a powder cosmetic to a human's face. The element numbers are provided as per FIG. 12.
Figure 18:
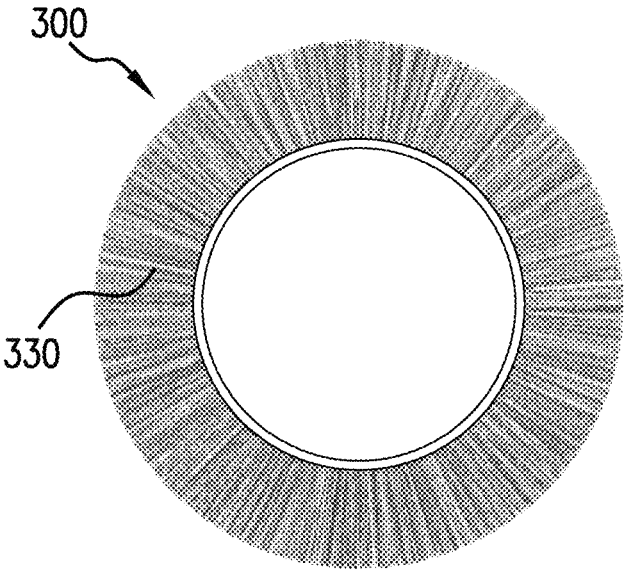
FIG. 18 generally depicts a bottom elevational plan view of an embodiment of a brush head with an inner zone of bristles have a convex configuration for application of a solid material to a surface, such as but not limited to application of a powder cosmetic to a human's face. The element numbers are provided as per FIG. 12.

Referring now to FIGS. 17-18, the brush head having a convex inner zone preferably has a circumferential shape that is substantially circular in a transverse cross sectional area or in a top elevational plan view. The inner zone and/or the outer zone may have a circular configuration. However, in alternate embodiments, the inner and outer zone may have the same or different circumferential shapes.

Figure 19:
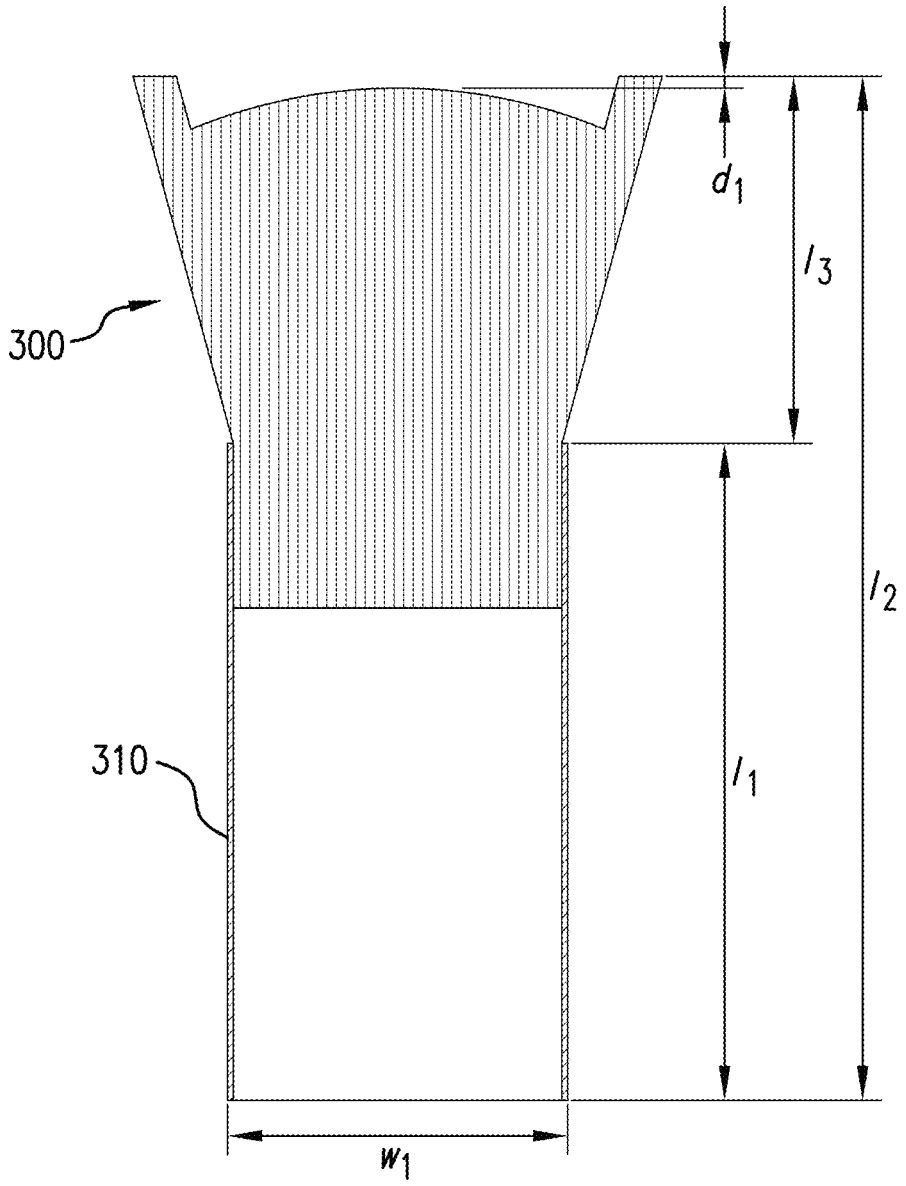
FIG. 19 generally depicts a longitudinal cross sectional view of an embodiment of a brush head with an inner zone of bristles have a convex configuration for application of a solid material to a surface. The bristles of the brush head (300) are secured within a ring (310), and the preferred dimensions are as follows. The invention not being limited to the particular dimensions or ratios, the ring (310) having a length, $l_1$, of about 55.5 mm, and a width, $w_1$, of about 28.7 mm. The brush head having a length extending outward from the upper end of the ring, $l_3$, of about 31 mm, such that the overall length of the ring and brush head, $l_2$, is about 86.5 mm. The error is +/−0.1% to about 10%, preferably about 0.5% to about 5%, and more preferably about 1% to about 2%.

Referring now to FIG. 19, an embodiment of the brush head having a convex inner zone of bristles is shown, wherein a ring used to hold the bristles is shown. In some embodiments, the brush and/or brush head may include a ring 310 that is positioned around the circumference of the brush head at a lower end thereof to secure or maintain the bristles of the inner zone and the outer zone in the desired configuration, as shown in FIG. 19. The ring 310 may have various shapes and sizes, and is preferably a hollow tube having at least one open end in which the bristles are positioned as shown. The ring 310 may extend the length of an interior of a handle of a brush, or may have a compact configuration and extend only along a portion of the length of the interior of the handle. The bristles are positioned within a central interior area defined by the ring 310, wherein the ring is positioned tightly around the bristles so as to apply tension to the bristles. Thus, the ring may be used to hold the bristles in the desired configuration, and glue or other adhesives may further be used to maintain the bristles in the desired configuration. In alternate embodiments, a crimping region or ferrule is provided for holding the bristles in the desired configuration.

The embodiment as shown in FIG. 12 having a convex inner zone is particularly useful for applying solid cosmetics, such as powdered foundation, bronzers, and highlighters, among others. In some embodiments, powdered cosmetics for use with the brush head may have a particle size of approximately 1 to about 100 microns, however, the brush may be suitable to apply solid materials having various particle sizes and distributions of sizes. In operation, a user can press the brush head into a solid material, such as a powdered cosmetic held within or on a surface, such as in a container, lid, or compact. Preferably, the brush head is moved in a circular or swirling motion so as to enable the powdered cosmetic to be retained on or within the brush head. By pressing the brush head into the powdered cosmetic, the powdered cosmetic is picked up in between and/or on top of the bristles of the brush head, and some of the powder may settle into gaps between the bristles. Specifically, it is contemplated that the powdered cosmetic is held in/on the bristles of the inner zone. The convex inner zone allows the bristles of the inner zone to more readily contact the powdered cosmetic held in a container, on a surface, or in a lid or dish as the powdered cosmetic is being applied to the brush than a brush head having a flat or concave inner zone of bristles. The outer zone surrounds the inner zone and preferably has a greater height which helps to retain the powdered cosmetic in and/or on the inner zone of bristles.

The powdered cosmetic is maintained on the brush head for application to a surface. The user can then bring the brush head with the solid cosmetic therein in contact with a surface, such as the user's skin for application. The brush head can be pressed, or brushed into the user's skin, and particularly in a circular, swirling or sweeping motion to cause the solid cosmetic to transfer from the brush head to the user's skin. Again, the convex configuration promotes contact of the inner zone with the surface on which the solid material is being applied. The outer zone of bristles helps to retain the solid cosmetic on the inner zone and is used to smooth and or buff the cosmetic once transferred to the surface.

In an additional aspect of any of the various embodiments of the present invention, the bristles can be made of natural material, synthetic material, or a combination thereof.

The bristles can be made of any appropriate material. Natural materials, including but not limited to animal products such as hair or plant materials such as fibers are useful in the present invention. Synthetic materials such as plastics, polymers, nylon, and other polymers or non-polymers are also useful in the present invention. In one embodiment, the bristles in the inner zone and/or the outer zone are composed of polybutylene terephthalate (PBT).

In another aspect of the present invention, the outer zone of bristles and the inner zone of bristles are made of the same or different material or combination of materials.

The brush heads of the present invention can be made of all of one type of bristles, or of more than one type of bristles. If more than one type of bristles, they can be provided mixed overall, or in different proportions in different areas of the brush head. The proportions can be anywhere from 0% to 100%

In a further aspect of the embodiment of the present invention as shown in FIGS. 1-11, the inner zone of bristles are of a greater pack density than the outer zone of bristles, that is the inner zone of bristles has more bristles per unit area. The inner zone of bristles having at least some portion that is lower than the height of the outer zone of bristles allows the two zones to define a reservoir in which a cosmetic can be supported for application. The greater pack density of the inner zone of bristles allows a cosmetic product to be supported on or in the inner zone of bristles so that a cosmetic and is maintained in the reservoir. The exact ratio of the pack density of the inner zone to the outer zone may vary depending upon the embodiment and the desired end use of the brush head. The outer zone of bristles does not have as great of a pack density as the inner zone, and the lower pack density allows for greater bristle movement or flexibility when applying the cosmetic. Thus, the difference in pack density allow allows for the inner zone and outer zones to have different effects when applying the cosmetic.

In such embodiments, the inner zone of bristles is preferably packed more densely as to, for example, a greater number of bristles per unit area, as compared to the outer zone of bristles. The length of the bristles can affect bristle density, as can the force on the brush head to keep the form in place, such as by a crimper or ferrule. The packing density of the bristles themselves can be achieved during the manufacturing process by having more bristles in some areas than others within the brush head, but that need not be the case.

In another aspect of the present invention, the brush heads have an inner zone of bristles that is less wettable than the outer zone of bristles.

Wettability refers to the ability of a liquid to absorb into a surface, such as the inner zone and outer zone of the brush head. Preferably, the wettability of the inner zone is less than the outer zone, so that a liquid material provided to the inner zone would "bead up" or otherwise not absorb into the bristles at that location and thus be more available for application to the subject at the location of application.

Wettability is, in some instances, related to the physical characteristics of the surface and the liquid being applied thereto, and can be measured by contact angle determinations. In one example, a hydrophilic liquid being applied to a hydrophobic surface would bead up on the surface and thus have a relatively high contact angle as compared to the contact angle of a hydrophilic liquid on a hydrophilic surface. In some instances, there is no contact angle as the liquid is absorbed into the surface, such as a drop of water being applied to cellulose filter paper or household tissue paper or paper towels. Contact angle determinations are well known in the art of material science, and one can choose materials and liquids such that a liquid would bead up on a surface or be absorbed into the surface.

In the present invention, the bristle density described herein appears to be related to wettability of the brush head as well, such as in the inner zone. Surfaces can also be coated or otherwise chemically modified to change their surface physical properties such as hydrophobicity and hydrophilicity, and thus one can choose or modify materials such that the desired wettability and/or beading is obtained for a particular liquid applied to a surface, such as the inner zone of the brush head of the present invention.

In one aspect of the brush heads of the present invention, the wettability of the inner zone is less than that of the outer zone, so that the material such as a liquid applied to the inner zone does not absorb into that area of the brush. The outer zone is preferably more wettable as to the material such as a liquid applied to the inner zone.

In a further aspect of the present invention, the inner zone of bristles has a greater or lesser contact angle than said outer zone of bristles with regards to a liquid, an aqueous solution, a polar solution, a non-aqueous solution, a non-polar solution, an emulsion, or a combination thereof.

In an additional aspect of the present invention, the inner zone of bristles is less wettable or more wettable than the outer zone of bristles as to an aqueous solution, a polar solution, a polar liquid, or a combination thereof.

In another aspect of the present invention, the inner zone of bristles is less wettable than the outer zone of bristles as to a non-aqueous solution, a non-polar solution, or a non-polar liquid, or a combination thereof.

In a further aspect of the present invention, the inner zone of bristles is less wettable than the outer zone of bristles as to an emulsion.

In an additional aspect of the present invention, the outer zone of bristles and the inner zone of bristles together define a reservoir for a material, such as but not limited to a liquid material. As the material is applied to a surface, the inner zone of bristles can in essence provide additional material for additional and sustained applications of material.

In another aspect of the present invention, the inner zone of bristles can be partially wettable as to a material, such as not limited to a liquid material. This aspect of the present invention is preferred when the inner zone of bristles acts as a reservoir for material. In this instance, the material can "seep into" the inner zone of bristles and still be available for application to a surface.

In another aspect of the present invention, the outer zone has greater buffing characteristics, reduces-streaking characteristics, or a combination thereof, than the inner zone.

In a preferred aspect of the present invention, during operation, the inner zone thus efficiently holds the material in place for application to the surface, and the outer zone acts to smooth, or buff, the application of the material on the surface for a desirable effect. A preferred desirable effect is a reduction in streaking or smearing of the material when applied to a surface, such as but not limited to a liquid cosmetic applied to a human subject.

However, in certain instances, such as for artistic purposes where streaking or smearing has a desirable effect, the present invention includes such aspects as well. Such instances can be, for example, hobby painting and other artistic expressions where incomplete mixing, streaking, shading, feathering, and the like are more desirable than a smooth, buffed appearance.

II. Brushes

A second aspect of the present invention relates to brushes that include at least one brush head of the present invention.

As is generally shown in the figures, the brush heads of the present invention are preferably provided as brushes. Included in each brush is preferably, but not limited to at least one brush head, at least one handle, optionally at least one crimping region, ring, or ferrule, and any combination thereof.

In a further aspect of the present invention, the brushes each include at least one handle.

As is generally shown in the figures, the brushes can include at least one handle. In the alternative, the brushes can include a handle with one or more brush heads. The handle can be made of any appropriate material known in the art, such as but not limited to wood, plastic, polymer, ceramic, glass, metal, such as aluminum, or a combination of these materials. The handle can be solid or hollow, and can be of unitary construction or made of a plurality of parts. The handle can be made using any appropriate method based on the material, including but not limited to carving, molding, lathing, injection molding, casting, or a combination thereof. In some embodiments, the handle may further include a weight or a weighted portion that is preferably located at a bottom or lower end thereof, opposite the end of the handle on which the brush head is positioned. The weight may serve to better balance or distribute the weight of the brush for ease and comfort of use. Further, the weight may help to allow the brush to be maintained in a standing position on a surface, such as a countertop when not in use.

In an additional aspect of the present invention, the brushes may include at least one crimping area, ring or ferrule.

As is generally shown in the figures, the brushes can include a crimping area, ring or ferrule. The crimping region or ferrule is generally used to keep the bristles of the brush heads in its desired configuration. The crimping region or ferrule can also be used to attach a brush head to a handle. Alternatively, the crimping region, ring or ferrule can be integral to the brush, such as but not limited to being integral to a handle, and in some aspects of the present invention may not be required.

III. Method of Making a Brush Head

A third aspect of the present invention is a method of making brush heads according to the present invention, including: a) providing bristles; and b) forming the brush heads of the present invention.

The brush heads of the present invention can be made using the routine methods used in the art. For example, the bristles can be arranged and formed into a brush head, either in final form or in a form that is later modified. Preferably, a crimping zone, ring or ferrule is provided to keep the bristles in a desired configuration, but that need not be the case.

In the instance where the bristles are first formed in a manner that is not the final form, the bristles can be cut in order to provide the final form. For example, the brush heads can be trimmed, cut with a cutting implement such as a knife or razor or scissors, cut with a laser, cut with a hot wire or other implement using heat or other forms of energy, flamed, sanding or other methods known in the art.

In either instance, the brush heads can be treated to round or otherwise make the ends of the bristles less sharp or less irritating to skin. Polishing or rounding methods known in the art can be used for this method.

IV. Method of Making a Brush

A fourth aspect of the present invention is a method of making brushes of the present invention, including: providing bristles; arranging the bristles into an inner zone and outer zone; forming the brush head of the present invention; and attaching one of the brush heads of the present invention to a handle.

Once a brush head is formed, such as with a crimping area, ring or ferrule. The brush head can be attached to a handle. Such methods of attaching a brush head to a handle are known in the art and are readily available and apparent from the literature.

In some instances, a crimping zone, ring or ferrule is present, but that need not be the case.

V. Method of Using a Brush Head

A fifth aspect of the present invention is a method of using the brush heads of the present invention, including: a) providing a surface to apply a material to; b) providing a brush head of present invention; c) applying a material to the brush head; and d) transferring the material from the brush head to the surface.

In another aspect of the present invention, the surface is a subject.

For certain purposes, such as cosmetic, medicament or medical purposes, the surface is a subject. The subject can be any animal, including non-mammals, mammals, primate and non-primate, and humans. Humans are preferable.

As set forth herein, the surface need not be a subject, but rather can be any surface of any material to which a material is desired to be delivered. Brush heads are used routinely in painting for profession such as a house or fence, pleasure such as a hobby, or for artistic purposes. For certain applications of the present invention, the reduced streaking and buffing are desirable, and can be incorporated into artistic expressions in, for example, paintings, where a variety of artistic tools are used. One interesting example is the use of the present invention in faux finishes on furniture, walls and ceilings, where the effects desired require tools such as those of the present invention.

In one preferred aspect of the present invention, the surface is a human, preferably the skin, and more preferably a surface that is exposed for public view. In that instance, the head, neck, shoulders, and face as to cosmetics is preferable, but that need not be the case, as certain cosmetics are used for concealing certain imperfections in pigmentation, scarring or from other sources. If the subject is human, the human can be male or female.

In an additional aspect of the present invention, the material is a cosmetic.

A preferred aspect of the present invention is one where the material to be provided to a subject is a cosmetic, as is set forth herein. Although a preferred aspect of the present invention, the present invention is clearly applicable to other technologies In another aspect of the present invention, the material is a liquid cosmetic.

Other types of cosmetics are also useful for application to a surface using the present invention. Those include powders, solids, packed powders and the like. Liquid refers to aqueous and non-aqueous liquids as set forth herein, be they polar, non-polar, organic, non-organic, aqueous, non-aqueous, emulsions, water in oil emulsions, oil in water emulsions, or any combination thereof.

In an additional aspect of the present invention, the inner and outer zones of bristles define a reservoir for a material, such as but not limited to a liquid material or a solid material, wherein the solid material is preferably in powder form. As material is applied to a surface, the inner zone of bristles can in essence provide additional material for additional and sustained applications of material. In embodiments where a liquid cosmetic is used, the liquid cosmetic can be applied to the brush and held within the reservoir for application to a surface. The liquid cosmetic is held within the reservoir and is prevented from flowing down along the bristles towards a bottom portion of the brush head or a handle attached thereto. The liquid cosmetic can then be applied to a surface within spilling or dripping.

In embodiments wherein a powdered cosmetic is used, a powdered cosmetic is provided, such as in a container, compact, or other packaging. An embodiment of the brush head having an inner zone of bristles with a convex configuration can be inverted and pressed into the powdered cosmetic such that the brush head contacts the powdered cosmetic. The powdered cosmetic is retained on the brush head, such as on or between the bristles of the inner zone, wherein the outer zone of bristles helps to maintain the powder within the inner zone. The brush head having the powdered cosmetic thereon can be applied to a surface so as to transfer the cosmetic to the surface. Preferably, the brush head is pressed against the surface in a circular or sweeping motion wherein the powdered cosmetic is released from the bristles and is transferred to the surface. The outer zone and/or inner zone of bristles can then be used to buff or smooth the cosmetic applied to the surface.

In another aspect of the present invention, the inner zone of bristles can be partially wettable as to a material, wherein the material is not limited to a liquid material. This aspect of the present invention is preferred when the inner zone of bristles acts as a reservoir for material. In this instance, the material can "seep into" the inner zone of bristles and still be available for application to a surface.

VI. Method of Using a Brush

A sixth aspect of the present invention is a method of using the brushes of the present invention, including: a) providing a surface to apply a material to; b) providing a brush of the present invention; c) applying a material to the brush; and d) transferring the material from the brush head to the surface.

In another aspect of the present invention, the surface is a subject. In a further aspect of the present invention, the surface is a human. In an additional aspect of the present invention, the material is a cosmetic. In another aspect of the present invention, the material is a liquid cosmetic. In another aspect of the present invention, the material is a powder-based cosmetic. In further embodiments, the material is a medicament, a cosmeceutical, or other material intended for topical application.

As set forth above for the method of using a brush head, the brush of the present invention can be used in the same or similar manner as the brush head and that section above is incorporated by reference herein.

EXAMPLES

Example 1: Development of Technology

This example provides for and establishes the early development of the technology and prototype brush head, brush, methods of making same, and methods of using same. In order to evaluate the application of Bare Escentuals' cosmetic liquid product (BARESKIN® PURE BRIGHTENING SERUM FOUNDATION, Item Number/Stock Keeping Number 70723, having the general characteristics of a viscous liquid, non-emulsion, specific gravity of 1.13-1.20, viscosity of 580-1,100 cp) application to a human surface, such as a face, a few drops of the liquid product are applied to a Bare Escentuals' standard large brush head made of polymer bristles (PBT-Polybutylene terephthalate) and then the liquid product on the brush head is applied to a human face. The result is streaking of the pigmented liquid product and that the liquid wetted or sank into the brush head.

The brush head is trimmed to a shorter length in "crew cut" type configuration and the application to that surface is repeated and the liquid product is noted not to appreciably wet or sink into the brush head surface but rather beads on the surface of the modified brush head.

The untrimmed brush head is noted to have buffing capability, which is a desirable characteristic for cosmetic application. A brush head with the general characteristics of the figures is made. The liquid product is applied to the central zone of the brush head, and is applied to a human surface, and the streaking of the applied liquid product is diminished or not appreciably observable or not observable. It is thought, though not wishing or intending to be bound by any mechanism, that the beaded up liquid product on the surface of the inner zone enhances application of the liquid product to the application surface, and the outer zone buffs or polishes the applied liquid material for a smooth, relatively or substantially untreated finish.

Further refinements are made and further prototypes and preferred embodiments developed. The product depicted in the figures result from such efforts.

Example 2: Preferred Embodiment of Brush Head and Brush

This example provides for and establishes a preferred aspect of the present invention, as presented in the figures.

A preferred brush head and brush for applying a liquid material, such as a liquid cosmetic, are provided in the figures. A preferred brush head and brush is Bare Escentuals' PERFECTING FACE BRUSH, Item Number/Stock Keeping Number 71184, having the general characteristics of PBT (Polybutylene terephthalate) bristles (0.7 mm PTV WAVE (a wavy/irregular shaped bristle), an anodized aluminum ferrule, and a wooden handle.

Figure 6:
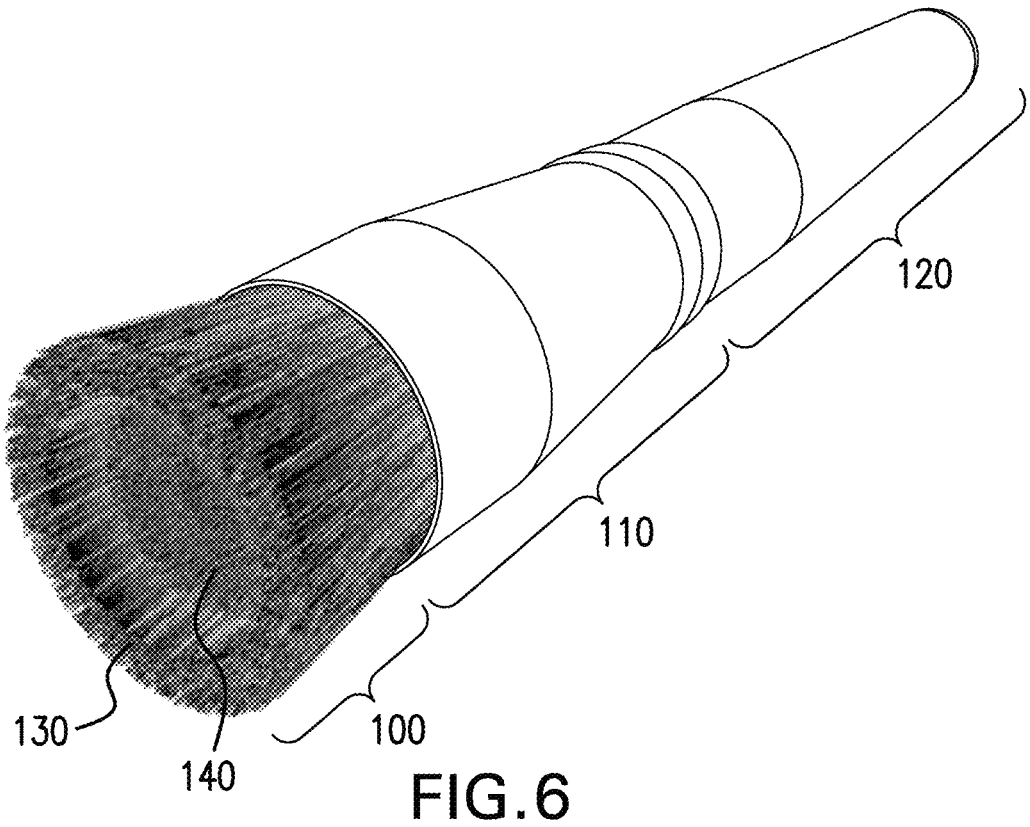
FIG. 6 generally depicts a front and right perspective view of one aspect of a brush of the present invention including a brush head with recessed bristles that can form a reservoir for material to be applied to a surface, such as but not limited to a liquid cosmetic material applied to a human subject's face (120). The brush includes a brush head (100), a ferrule (110) and a handle (120). The brush head includes an outer zone of bristles (130) and an inner zone of recessed bristles (140).
Figure 7:
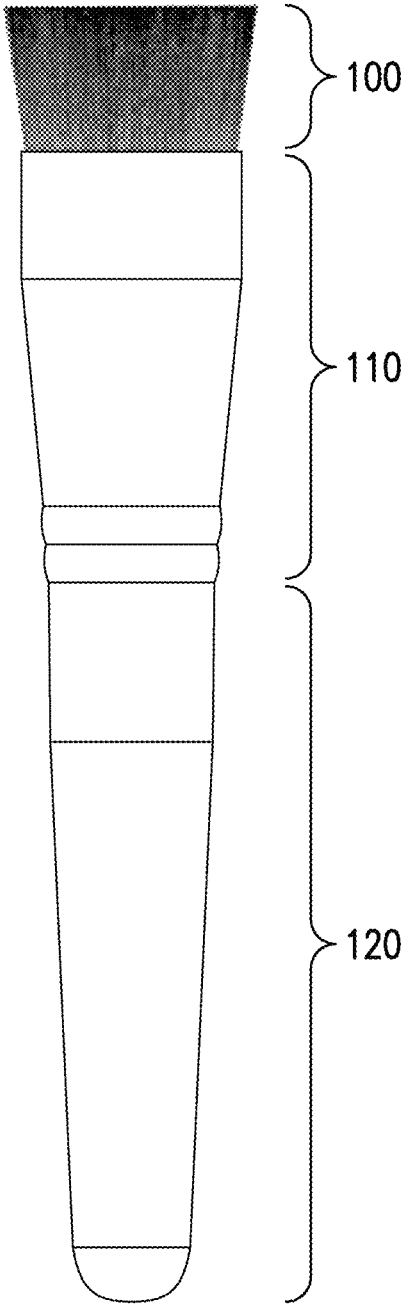
FIG. 7 generally depicts a right side view of one aspect of a brush of the present invention including a brush head with recessed bristles that can form a reservoir for material to be applied to a surface, such as but not limited to a liquid cosmetic material applied to a human subject's face, the left side, front side, and back side being mirror image thereof. The element numbers as are provided in FIG. 6.
Figure 8:
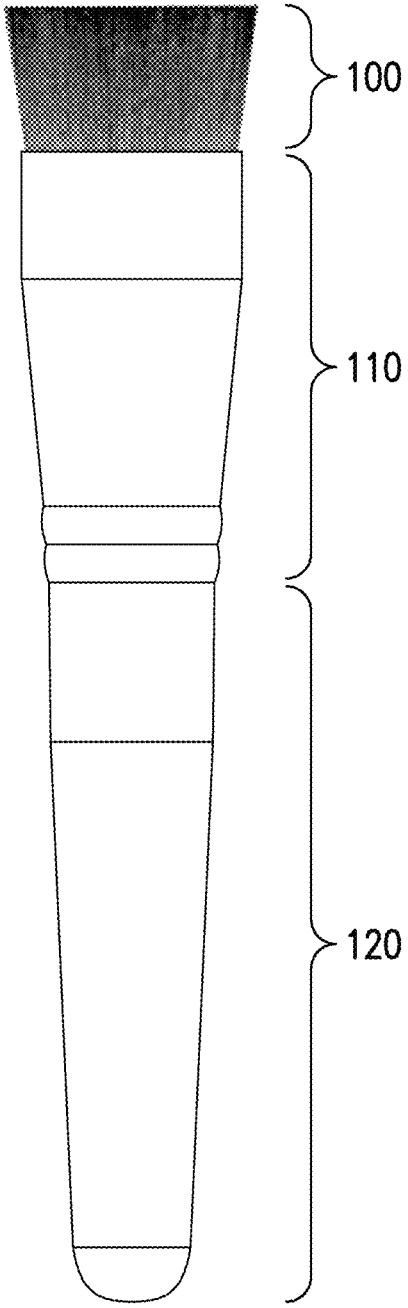
FIG. 8 generally depicts a left side, front side, and back side view of one aspect of a brush of the present invention including a brush head with recessed bristles that can form a reservoir for material to be applied to a surface, such as but not limited to a liquid cosmetic material applied to a human subject's face, as per FIG. 7. The element numbers as are provided in FIG. 6.
Figure 9:
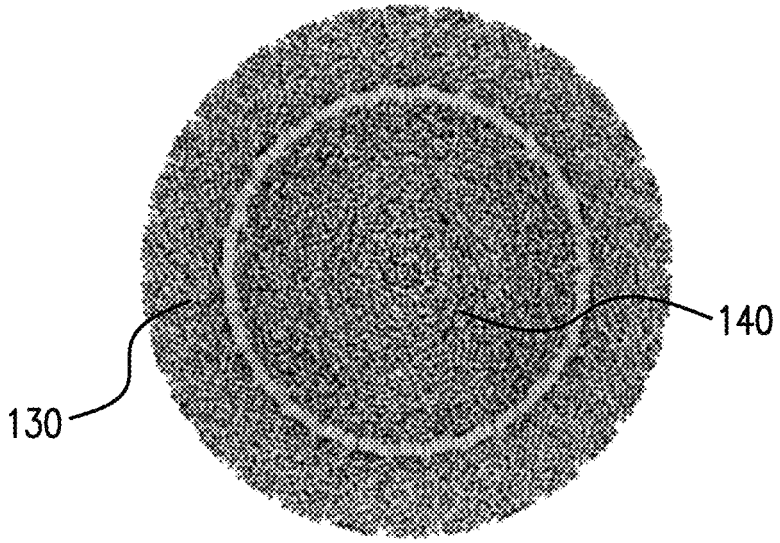
FIG. 9 generally depicts a top view of one aspect of a brush of the present invention including a brush head with recessed bristles that can form a reservoir for material to be applied to a surface, such as but not limited to a liquid cosmetic material applied to a human subject's face. The element numbers as are provided in FIG. 6.
Figure 10:
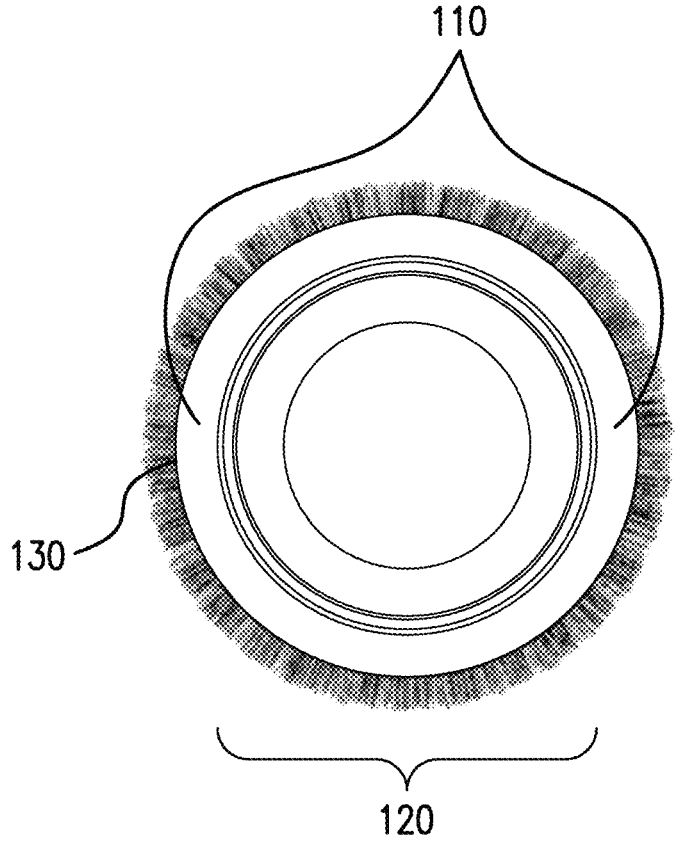
FIG. 10 generally depicts a bottom view of one aspect of a brush of the present invention including a brush head with recessed bristles that can form a reservoir for material to be applied to a surface, such as but not limited to a liquid cosmetic material applied to a human subject's face. The element numbers as are provided in FIG. 6.
Figure 11:
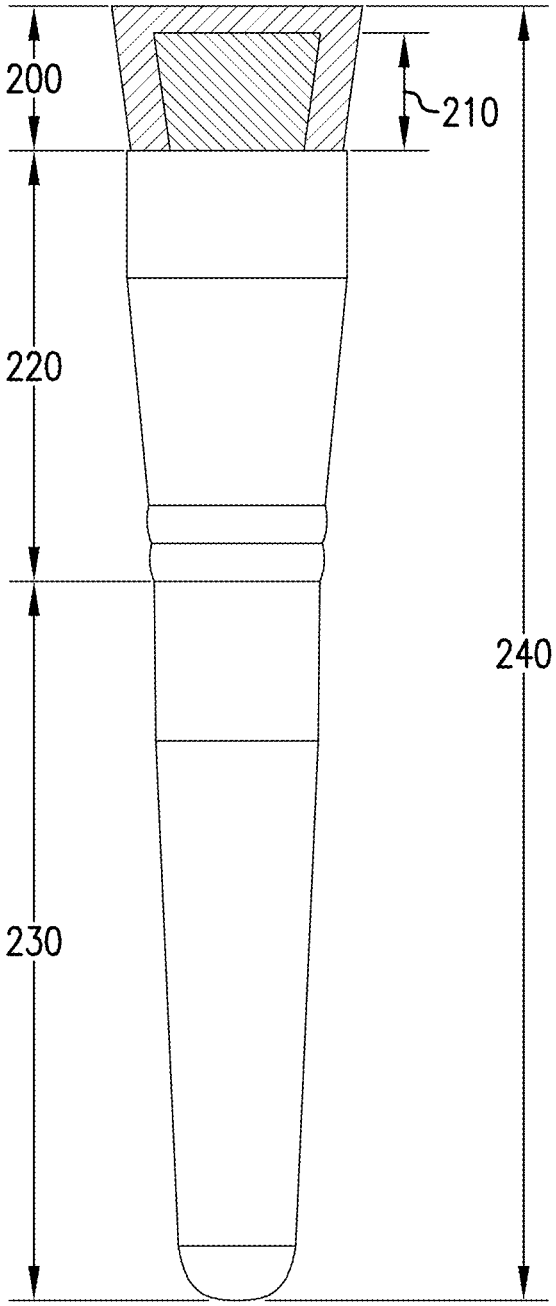
FIG. 11 generally depicts a preferred brush of the present invention including a brush head with recessed bristles that can form a reservoir for material to be applied to a surface, such as but not limited to a liquid cosmetic material applied to a human subject's face, showing preferred dimensions as follows. For example, the invention not being limited to the particular dimensions or ratios, 200 being about 16.5 mm, 210 being about 13.5 mm, 222 being about 45 mm, 230 being about 75 mm, and 240 being about 136.5 mm. The error is between about +/− about 0.1% and about 10%, preferably between about 0.5% and about 5%, and more preferably between about 1% and about 2%. The particular sizes and ratios can be adapted to a particular brush head or brush for a particular purpose and function. The brush head is shown in cross hatch of differing angles to highlight the difference between the outer zone of bristles and the inner zone of bristles in order to show the dimensions clearly.

As show in FIG. 1 and FIG. 6, the brush can include a brush head (100), a ferrule (110) and a handle (120). The brush head can include an outer zone of bristles (130) and an inner zone of recessed bristles (140). Overall, FIG. 1, FIG. 2, FIG. 3, FIG. 4, FIG. 5, FIG. 6, FIG. 7, FIG. 8, FIG. 9, FIG. 10, and FIG. 11 all show brush heads and brushes of the present invention, such as Bare Escentuals' PERFECTING FACE BRUSH, Item Number/Stock Keeping Number 71184, having the general characteristics of PBT (Polybutylene terephthalate) bristles 0.7 mm PTV WAVE (a wavy/irregular shaped bristle), an anodized aluminum ferrule, and a wooden handle. The general dimensions are provided in FIG. 11. FIG. 11 also provides preferred dimensions and preferred ratios of dimensions of a brush and brush head of the present invention in millimeters. For example, the invention not being limited to the particular dimensions or ratios, 200 being about 16.5 mm, 210 being about 13.5 mm, 222 being about 45 mm, 230 being about 75 mm, and 240 being about 136.5 mm. The error is between about +/− about 0.1% and about 10%, preferably between about 0.5% and about 5%, and more preferably between about 1% and about 2%. The particular sizes and ratios can be adapted to a particular brush head or brush for a particular purpose and function.

Example 3: Preferred Method of Making the Preferred Brush Head and Brush

This example provides for and establishes a preferred aspect of the present invention, as presented in FIGS. 1-11.

Generally, the brush head and brush of the present invention are made in the general manner known in the art. Bristles in a non-final configuration are attached to the handle by way of the ferrule. The bristles are then shaped into the desired configuration by way of trimming.

As show in FIG. 1 and FIG. 6, the brush can include a brush head (100), a ferrule (110) and a handle (120). The brush head includes an outer zone of bristles (130) and an inner zone of recessed bristles (140). Overall, FIG. 1, FIG. 2, FIG. 3, FIG. 4, FIG. 5, FIG. 6, FIG. 7, FIG. 8, FIG. 9, FIG. 10, and FIG. 11 all show preferred brush heads and brushes of the present invention for application of a liquid cosmetic to a surface.

Example 4: Preferred Method of Using the Preferred Brush Head and Brush

This example provides for and establishes a preferred aspect of the present invention, as presented in the figures.

The user grasps the handle of the brush, such as Bare Escentuals' PERFECTING FACE BRUSH, Item Number/Stock Keeping Number 71184 and applies the cosmetic to the inner zone. In the preferred aspect of the present invention, a few drops of a liquid cosmetic material, such as BARESKIN® PURE BRIGHTENING SERUM FOUNDATION, Item Number/Stock Keeping Number 70723, are used. The user then optionally dabs or dots the cosmetic from the surface from the inner zone of the brush head, such as the user's or other subject's skin. The cosmetic can be applied to the surface in any desired pattern or amount for a desired outcome. The cosmetic is thus applied to that surface. The brush is used to buff the cosmetic for a desirable non-streaked, consistent and "clean" application. Optionally, the cosmetic is not so dabbed or dotted onto the subject, but rather simultaneously applied and buffed to likewise obtain a desired result.

As show in FIG. 1 and FIG. 6, the brush can include a brush head (100), a ferrule (110) and a handle (120). The brush head includes an outer zone of bristles (130) and an inner zone of recessed bristles (140). Overall, FIG. 1, FIG. 2, FIG. 3, FIG. 4, FIG. 5, FIG. 6, FIG. 7, FIG. 8, FIG. 9, FIG. 10, and FIG. 11 all show preferred brush heads and brushes of the present invention for applying a liquid cosmetic to a surface.

The general dimensions are provided in FIG. 11. FIG. 11 also provides preferred dimensions and preferred ratios of dimensions of the particularly preferred brush and brush head of the present invention in mm. For example, the invention not being limited to the particular dimensions or ratios, 200 being about 16.5 mm, 210 being about 13.5 mm, 222 being about 45 mm, 230 being about 75 mm, and 240 being about 136.5 mm. The error is between about +/− about 0.1% and about 10%, preferably between about 0.5% and about 5%, and more preferably between about 1% and about 2%. The particular sizes and ratios can be adapted to a particular brush head or brush for a particular purpose and function.

The user can also optionally apply the cosmetic to the outer zone as desired to obtain a desired outcome under circumstances that dictate departure from preferred uses as indicated. The entire surface, such as a human face, can be treated, or just a portion thereof.

The process generally distributes the cosmetic such as a liquid foundation evenly, removes excess product, and gives it a more skin-like texture and appearance than when alternative brushes or methods are used.

In a preferred aspect of the present invention, the user drops liquid foundation product into the recessed bristle area having material application and buffing properties. The "loaded" brush is then applied in a dotting motion to areas around the face to disperse the product on the face. The user then buffs the brush over the dots to evenly distribute the product over the entire facial area or desired smaller section. Preferably, at no point does the user need to apply the product anywhere other than the brush and face. For example, the fingers and hands of the user can preferably stay clean and free or substantially free of or from product throughout the duration of the use of the brush. This aspect of the present invention has certain advantages, such as not carrying or transferring material to other surfaces or objects, including but not limited to clothing and furniture.

In an additional preferred aspect of the present invention, the inner zone of bristles form a reservoir for a material, such as but not limited to a liquid material. As material is applied to a surface, the inner zone of bristles can in essence provide additional material for additional and sustained applications of material.

In another preferred aspect of the present invention, the inner zone of bristles can be partially wettable as to a material, such as not limited to a liquid material. This aspect of the present invention is preferred when the inner zone of bristles acts as a reservoir for material. In this instance, the material can "seep into" the inner zone of bristles and still be available for application to a surface.

Example 5: Preferred Brush Head and Brush

A preferred brush head and brush for applying a solid cosmetic, such as a powdered cosmetic, is shown in the embodiments of FIGS. 12-21. A preferred brush head and brush is Bare Escentuals' BEAUTIFUL FINISH brush, having the general characteristics of waved synthetic fibers, such as polybutylene terephthalate (PBT) bristles having a diameter of 0.07 mm, an anodized aluminum handle, and an aluminum ring that secures and holds the bristles in place. In the preferred embodiment, the brush further includes a small weight (380) located at a lower end of the handle, opposite the brush head, on the interior of the handle.

Figure 20:
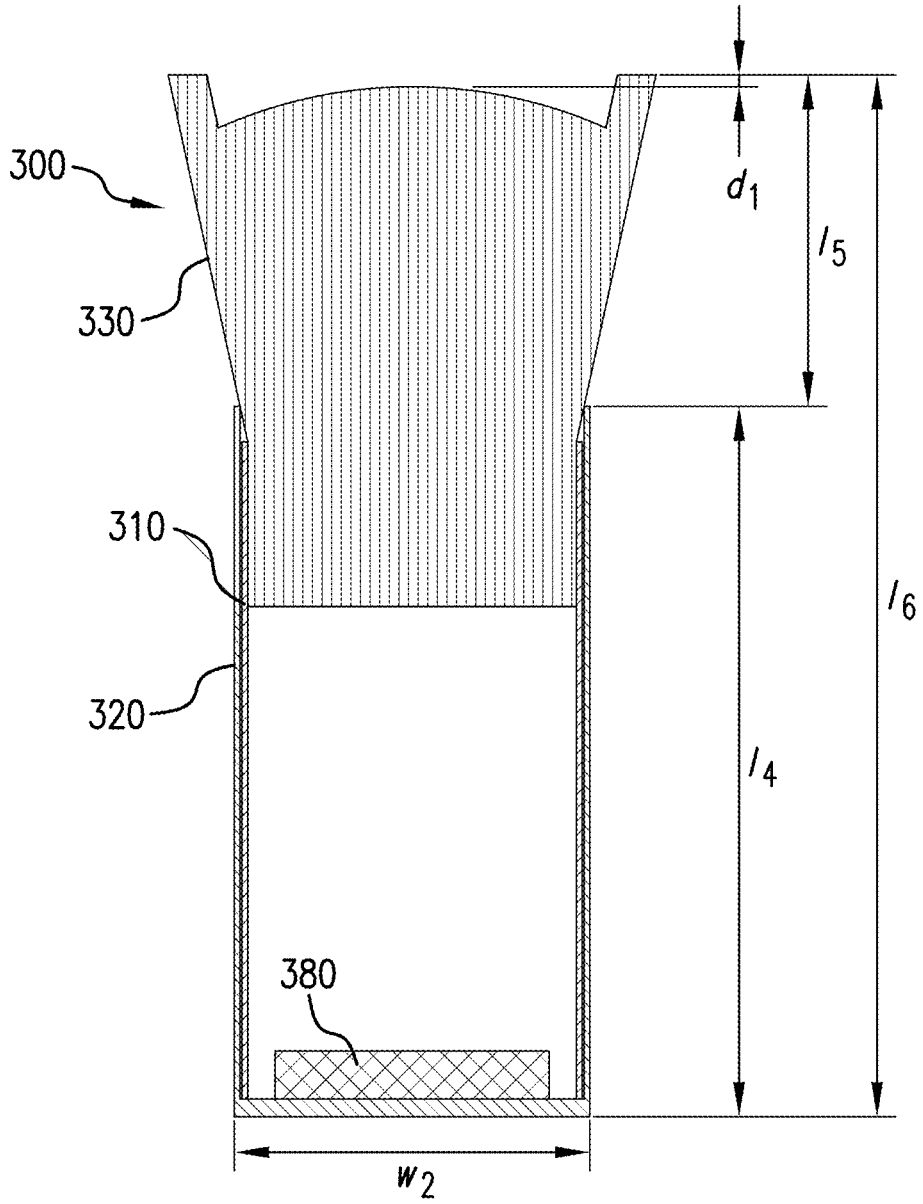
FIG. 20 generally depicts a longitudinal cross sectional view of an embodiment of a brush head with an inner zone of bristles have a convex configuration for application of a solid material to a surface, such as but not limited to application of a powder cosmetic to a human's face, wherein the brush optionally includes a weight, and wherein the preferred dimensions are shown as follows. For example, the invention not being limited to the particular dimensions or ratios, the handle (320) having a length, $l_4$, of about 60 mm and a width, $w_2$, of about 30 mm, the brush head (330) having a length extending from the handle, $l_5$, of about 28 mm, and the highest point of the inner zone of bristles being lower than the height of the outer zone of bristles by a difference, $d_1$, of about 1.0 mm. The error is +/−0.1% to about 10%, preferably about 0.5% to about 5%, and more preferably about 1% to about 2%. The particular sizes and ratios can be adapted to a particular brush head or brush for a particular purpose and function.

The general dimensions for a preferred embodiment of the brush are provided in FIGS. 19 and 20. FIGS. 19 and 20 also provide preferred dimensions and preferred ratios of dimensions for the preferred brush and brush head for applying a solid material of the present invention in millimeters. For example, the present invention not being limited to the particular dimensions or ratios, the handle (320) having a length, $l_4$, of about 60 mm and a width, $w_2$, of about 30 mm. Thus, the ratio of the length of the handle to the width of the handle may be between about 4:1 to 1:1, and is 2:1 in a preferred embodiment. The handle (320) is preferably of a generally cylindrical construction. The ring (310) preferably has a length, $l_1$, of about 55.5 mm and a width, $w_1$, of about 28.7 mm, such that the ring fits closely within the handle, wherein the brush head has a length extending from the ring, $l_3$, of about 31 mm, such that the overall length of the ring and brush head, $l_2$, is about 86.5 mm. The outer zone (330) of bristles has a length extending from the handle, $l_5$, of about 28 mm, such that the overall length of the brush including the handle and brush head, $l_6$, is about 88 mm. The highest point of the inner zone (340) is lower than the outer zone of bristles by a difference, $d_1$, of about 1.0 mm. The error is +/−0.1% to about 10%, preferably about 0.5% to about 5%, and more preferably about 1% to about 2%. The particular sizes and ratios can be adapted to a particular brush head or brush for a particular purpose and function.

Example 6: Method of Using the Brush Head and Brush

Figure 21:
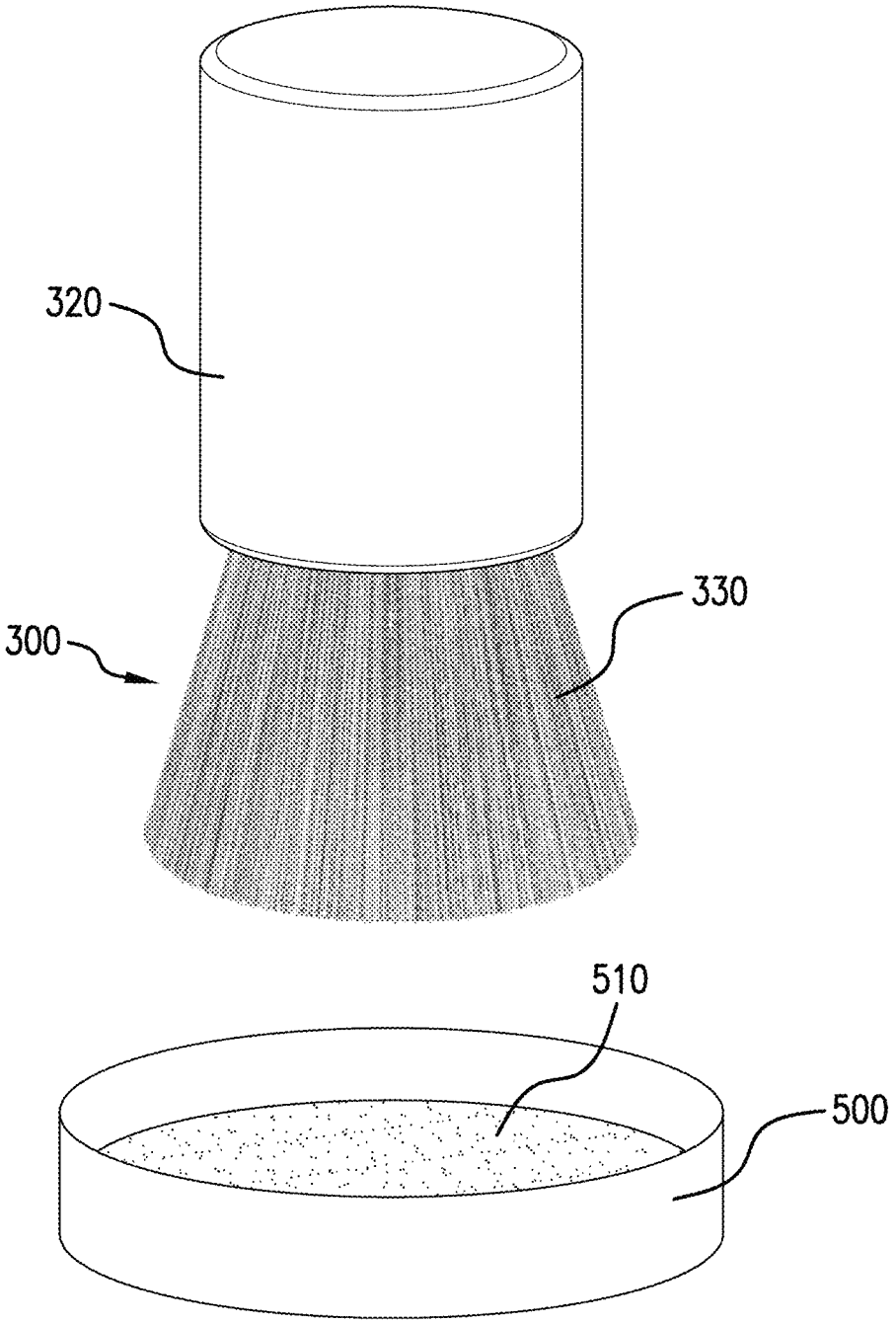
FIG. 21 generally depicts a perspective view of an embodiment of a brush head with an inner zone of bristles have a convex configuration for application of a solid material to a surface, such as but not limited to application of a powder cosmetic to a human's face, wherein the brush head is being used to retain a solid cosmetic (510) held or stored within a lid or container (500).

This example provides for and establishes a preferred aspect of the present invention, as presented in FIGS. 12-21. FIG. 21 depicts an embodiment of a brush as used in combination with a solid cosmetic (510), wherein the brush is used to transfer the solid cosmetic that is stored within a container (500) to a surface.

In use, the user grasps the handle of the brush, such as Bare Escentuals' BEAUTIFUL FINISH brush and inverts the brush so as to position the brush head into a container or a lid having a solid material therein, such as into Bare Escentuals' ORIGINAL Foundation Broad Spectrum SPF 15, which provides a circular shaped lid in which the solid foundation is positioned. The user can apply downward pressure to engage the brush head, particularly the convex inner zone thereof, with the solid material and move the brush in a circular or swirling motion in order to allow the solid cosmetic to be picked up and retained by the brush head, wherein the cosmetic is held or and/or within the inner zone of bristles and the outer zone of bristles helps to hold the cosmetic within the brush head. The user may then transfer the solid material by applying bring the brush head into contact with the surface, such as a person's skin, and the user may applying slight pressure and move the brush in a circular motion or in a brushing motion so apply the material to the surface, wherein the wide brush head allows the brush head to cover large areas quickly and deposit a large amount of product on the surface. The brush head, particularly the outer zone thereof, can then be used to buff and smooth the cosmetic onto the surface to deliver fast, even and controlled coverage of the surface.

All publications, including patent documents and scientific articles, referred to in this application and the bibliography and attachments, are incorporated by reference in their entirety for all purposes to the same extent as if each individual publication were individually incorporated by reference, All headings are for the convenience of the reader and should not be used to limit the meaning of the text that follows the heading, unless so specified.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A brush head for applying a solid material, comprising:

an outer zone of bristles and an inner zone of recessed bristles, defining a reservoir;

wherein the inner zone of recessed bristles is convex in longitudinal cross section and the inner zone of recessed bristles is configured to retain a solid material for application to a surface.

2. The brush head of claim 1, wherein the inner zone of recessed bristles is rounded in longitudinal cross section.

3. The brush head of claim 1, wherein the outer zone of bristles has a flat surface defined by tips of the bristles.

4. The brush head of claim 1, wherein the outer zone of bristles comprises an outwardly tapered configuration.

5. The brush head of claim 1, wherein a circumferential shape of the outer zone of bristles in a transverse cross sectional view has a generally circular shape.

6. The brush head of claim 5, wherein a circumferential shape of the inner zone of recessed bristles in a transverse cross sectional view has a generally circular shape.

7. The brush head of claim 1, wherein the inner zone of recessed bristles comprises a greater pack density than that of the outer zone of bristles.

8. The brush head of claim 1, wherein a highest point of the inner zone of recessed bristles is below the height of the outer zone of bristles.

9. The brush head of claim 1, wherein the solid material is a powdered cosmetic.

10. The brush head of claim 1, wherein the solid material is a medicament.

11. A system for applying a cosmetic using a brush head, comprising:

a brush head comprising an outer zone of bristles and an inner zone of recessed bristles, defining a reservoir;

wherein the inner zone of recessed bristles is convex in a longitudinal cross section and the inner zone of recessed bristles is configured to hold a cosmetic for application to a surface.

12. The system of claim 11, wherein the inner zone of bristles is rounded in longitudinal cross section.

13. The system of claim 11, further comprising a handle.

14. The system of claim 13, further comprising at least one crimping area, ring, or ferrule.

15. The system of claim 11, wherein the cosmetic is a powdered cosmetic.

16. The brush head of claim 11, wherein the cosmetic is a medicament.

17. A method of using a brush head for applying a cosmetic, comprising:

providing a brush head having an outer zone of bristles and an inner zone of recessed bristles, defining a reservoir, wherein the inner zone of recessed bristles is convex in a longitudinal cross section;

applying a cosmetic to the brush head, such that the brush head retains the cosmetic;

transferring the cosmetic to a surface.

18. The method of claim 17, wherein applying a cosmetic to the brush head comprises pressing the brush head into a cosmetic such that the cosmetic is held on top of and/or between the bristles of the inner zone of recessed bristles.

19. The method of claim 17, wherein transferring the cosmetic to a surface comprises pressing the brush head against the surface so as to place the cosmetic in contact with the surface.

20. The method of claim 19, wherein pressing the brush head against a surface comprises moving the brush head in a circular motion or a sweeping motion on the surface.

21. The method of claim 17, further comprising moving the outer zone of bristles against the surface so as to buff and/or smooth the cosmetic.

22. The method of claim 17, wherein the cosmetic is a powdered cosmetic.

23. The method of claim 17, wherein the cosmetic is a medicament.

24. A method of making a brush head, comprising:

providing bristles;

arranging the bristles into an inner zone of recessed bristles and an outer zone of bristles; and forming a brush head comprising an outer zone of bristles and an inner zone of recessed bristles, defining a reservoir, wherein the inner zone of recessed bristles is convex in longitudinal cross section.

25. The method of claim 24, further comprising attaching the brush head to a handle.

26. The method of claim 24, further comprising securing the bristles within a crimping region, ring, or ferrule.

27. A method of making a brush head of claim 1, comprising:

providing bristles;

arranging the bristles into an inner zone of recessed bristles and an outer zone of bristles;

forming the brush head of claim 1.

28. The method of making a brush head of claim 27, further comprising attaching the brush head to a handle.

29. The method of making a brush head of claim 27, further comprising securing the bristles within a crimping region, ring, or ferrule.

* * * * *